US011001469B2

(12) United States Patent
Nakamura

(10) Patent No.: US 11,001,469 B2
(45) Date of Patent: May 11, 2021

(54) PRINTING APPARATUS WITH JAM RELEASE MECHANISM

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/725,605

(22) Filed: Oct. 5, 2017

(65) Prior Publication Data

US 2018/0117929 A1 May 3, 2018

(30) Foreign Application Priority Data

Oct. 31, 2016 (JP) ..... JP2016-213013

(51) Int. Cl.
*B65H 43/04* (2006.01)
*B65H 85/00* (2006.01)
(Continued)

(52) U.S. Cl.
CPC ..... *B65H 43/04* (2013.01); *B65H 5/062* (2013.01); *B65H 7/02* (2013.01); *B65H 29/125* (2013.01);
(Continued)

(58) Field of Classification Search
CPC ... B65H 7/02; B65H 7/06; B65H 7/14; B65H 7/20; B65H 85/00; B65H 29/60;
(Continued)

(56) References Cited

U.S. PATENT DOCUMENTS 5,797,068 A * 8/1998 Otsuki ..... G03G 21/1638 271/9.01
7,346,294 B2 * 3/2008 Lee ..... G03G 15/6529 399/124
(Continued)

FOREIGN PATENT DOCUMENTS

JP 2004-262665 A 9/2004
JP 2010-083662 A 4/2010
(Continued)

OTHER PUBLICATIONS

Official Action dated Jun. 23, 2020 in the counterpart Japanese application No. 2016-213013 and English translation thereof.

*Primary Examiner* — Howard J Sanders
(74) *Attorney, Agent, or Firm* — Greenblum & Bernstein, P.L.C.

(57) ABSTRACT

A printing apparatus includes: a conveyor including a first pair of conveyance rollers and a second pair of conveyance rollers each configured to nip and convey a sheet; a first jam releaser configured to separate rollers of the first pair of conveyance rollers from each other; a second jam releaser configured to separate rollers of the second pair of conveyance rollers from each other; and a controller configured to control the conveyor. In stopping sheet conveyance by the conveyor upon occurrence of a failure, the controller controls the conveyor to prevent a sheet from being nipped only by the first pair of conveyance rollers prior to separation of the rollers of the first pair of conveyance rollers from each other by the first jam releaser.

9 Claims, 13 Drawing Sheets

(51) Int. Cl.

| | |
|---|---|
| ***B65H 29/12*** | (2006.01) |
| ***B65H 5/06*** | (2006.01) |
| ***B65H 7/02*** | (2006.01) |
| ***G03G 21/16*** | (2006.01) |
| *G03G 15/23* | (2006.01) |

(52) U.S. Cl.
CPC ..... *B65H 85/00* (2013.01); *G03G 21/1638* (2013.01); *B65H 2220/01* (2013.01); *B65H 2301/33312* (2013.01); *B65H 2402/45* (2013.01); *B65H 2404/1521* (2013.01); *B65H 2511/20* (2013.01); *B65H 2511/224* (2013.01); *B65H 2511/528* (2013.01); *B65H 2513/40* (2013.01); *B65H 2513/511* (2013.01); *B65H 2513/512* (2013.01); *B65H 2601/11* (2013.01); *B65H 2601/325* (2013.01); *B65H 2801/06* (2013.01); *G03G 15/23* (2013.01); *G03G 21/1633* (2013.01); *G03G 2215/00544* (2013.01)

(58) Field of Classification Search
CPC ..... B65H 2511/528; B65H 2601/11; B65H 2404/144; B65H 2404/1441; G03G 15/23; G03G 15/231; G03G 15/232; G03G 15/234; G03G 15/6573; G03G 2215/0043; G03G 2215/00434; G03G 2215/00438
See application file for complete search history.

(56) References Cited

U.S. PATENT DOCUMENTS

| | | | | |
|---|---|---|---|---|
| 7,883,087 | B2 * | 2/2011 | Kitano | B65H 7/06 271/256 |
| 8,260,158 | B2 * | 9/2012 | Goto | G03G 15/6573 399/20 |
| 9,104,165 | B2 * | 8/2015 | Eguchi | G03G 15/706 |
| 9,272,867 | B2 * | 3/2016 | Kaneko | B65H 7/06 |
| 9,857,752 | B2 * | 1/2018 | Nishi | G03G 15/55 |
| 2017/0225917 | A1 * | 8/2017 | Kakita | G03G 15/6529 |

FOREIGN PATENT DOCUMENTS

| | | |
|---|---|---|
| JP | 2010-131859 | 6/2010 |
| JP | 2014-073881 A | 4/2014 |
| JP | 2016-160071 A | 9/2016 |
| JP | 2016-175316 A | 10/2016 |

* cited by examiner

PRINTING APPARATUS WITH JAM RELEASE MECHANISM

CROSS REFERENCE TO RELATED APPLICATION

This application is based upon and claims the benefit of priority from the prior Japanese Patent Application No. 2016-213013, filed on Oct. 31, 2016, the entire contents of which are incorporated herein by reference.

BACKGROUND

1. Technical Field

The disclosure relates to a printing apparatus configured to print on a sheet while conveying the sheet.

2. Related Art

Japanese Patent Application Publication No. 2010-131859 describes a printing apparatus configured to print on a sheet while conveying the sheet. If the above printing apparatus stops sheet conveyance due to the occurrence of a sheet jam or the like, a sheet being conveyed may remain in the apparatus. The sheet remaining in the apparatus is removed by jam release work performed by a user.

For the jam release work by a user, the printing apparatus is provided with a door through which the user can access a sheet on a conveyance route. In a known mechanism, one roller of a pair of conveyance rollers configured to convey a sheet is attached to such a door, and when the door is opened, the rollers of the pair of conveyance rollers are separated from each other. Such a mechanism facilitates the jam release work by a user.

SUMMARY

In the above-described printing apparatus, depending on the installation position of the door, there may be a case where a sheet falls to a place without a mechanism for taking out the sheet when the door for jam release is opened to release the nip for the sheet by the pair of conveyance rollers. Extra work is then needed to remove the sheet which has fallen to such a place.

The disclosure is directed to a printing apparatus capable of reducing sheets that fall to a place without a mechanism for taking out sheets.

A printing apparatus in accordance with some embodiments includes: a conveyor including a first pair of conveyance rollers and a second pair of conveyance rollers each configured to nip and convey a sheet; a first jam releaser configured to separate rollers of the first pair of conveyance rollers from each other, the first jam releaser causing a sheet nipped only by the first pair of conveyance rollers to fall to a place without a mechanism for taking out the sheet when releasing nip of the sheet by separating the rollers of the first pair of conveyance rollers from each other; a second jam releaser configured to separate rollers of the second pair of conveyance rollers from each other; and a controller configured to control the conveyor. In stopping sheet conveyance by the conveyor upon occurrence of a failure, the controller controls the conveyor to prevent a sheet from being nipped only by the first pair of conveyance rollers prior to separation of the rollers of the first pair of conveyance rollers from each other by the first jam releaser.

The above configuration can make it less likely that when the first jam releaser is operated for failure release work, a second sheet other than a first sheet causing the jam falls to a place without a mechanism for taking out the sheet. As a result, sheets falling to a place without a mechanism for taking out the sheets can be reduced.

In stopping the sheet conveyance by the conveyor upon occurrence of a sheet jam, the controller may control the conveyor to prevent a second sheet other than a first sheet causing the sheet jam from being stopped while nipped only by the first pair of conveyance rollers.

The above configuration can make it less likely that when the first jam releaser is operated for failure release work, a second sheet other than a first sheet causing the jam falls to a place without a mechanism for taking out the sheet. As a result, sheets falling to a place without a mechanism for taking out the sheets can be reduced.

The controller may: upon a position of a first sheet causing a sheet jam at a time of occurrence of the sheet jam satisfying a condition, stop the sheet conveyance by the conveyor altogether at the time of the occurrence of the sheet jam; upon a second sheet other than the first sheet being stopped while nipped only by the first pair of conveyance rollers when the sheet conveyance is stopped altogether, provide a user with a notification instructing to remove a sheet other than the second sheet from the conveyor; and upon determining that the sheet other than the second sheet has been removed, control the conveyor to move the second sheet until the second sheet is nipped by the second pair of conveyance rollers.

The above configuration prevents a first sheet causing a jam from being conveyed when a second sheet nipped only by the first pair of conveyance rollers at the time of the occurrence of the jam is conveyed until it is nipped by the second pair of conveyance rollers. This consequently suppresses aggravation of jam damage which would be caused if the first sheet causing the jam were conveyed.

The condition may include a condition where the position of the first sheet at the time of the occurrence of the sheet jam is between the first pair of conveyance rollers and the second pair of conveyance rollers.

The controller may: stop the sheet conveyance by the conveyor altogether at a time of occurrence of a sheet jam; upon a second sheet other than a first sheet causing the sheet jam being stopped while nipped only by the first pair of conveyance rollers when the sheet conveyance is stopped altogether, provide a user with a notification instructing to remove a sheet other than the second sheet from the conveyor; and upon determining that the sheet other than the second sheet has been removed, control the conveyor to move the second sheet until the second sheet is nipped by the second pair of conveyance rollers.

The above configuration makes it less likely that the first jam releaser is operated by a user with the second sheet nipped only by the first pair of conveyance rollers. As a result, sheets falling to a place without a mechanism for taking out the sheets can be reduced.

The controller may: upon a particular sheet being stopped while nipped only by the first pair of conveyance rollers when the sheet conveyance by the conveyor is brought to an emergency stop due to a failure other than the sheet conveyance by the conveyor, provide a user with a notification instructing to remove a sheet other than the particular sheet from the conveyor; and upon determining that the sheet other than the particular sheet has been removed, control the conveyor to move the particular sheet until the particular sheet is nipped by the second pair of conveyance rollers.

The above configuration makes it less likely that the first jam releaser is operated with the particular sheet being nipped only by the first pair of conveyance rollers. As a result, sheets falling to a place without a mechanism for taking out the sheets can be reduced.

The first jam releaser may be a first door through which a user accesses a conveyance route for the sheet, and the second jam releaser may be a second door through which the user accesses the conveyance route for the sheet.

DETAILED DESCRIPTION

Figure 1:
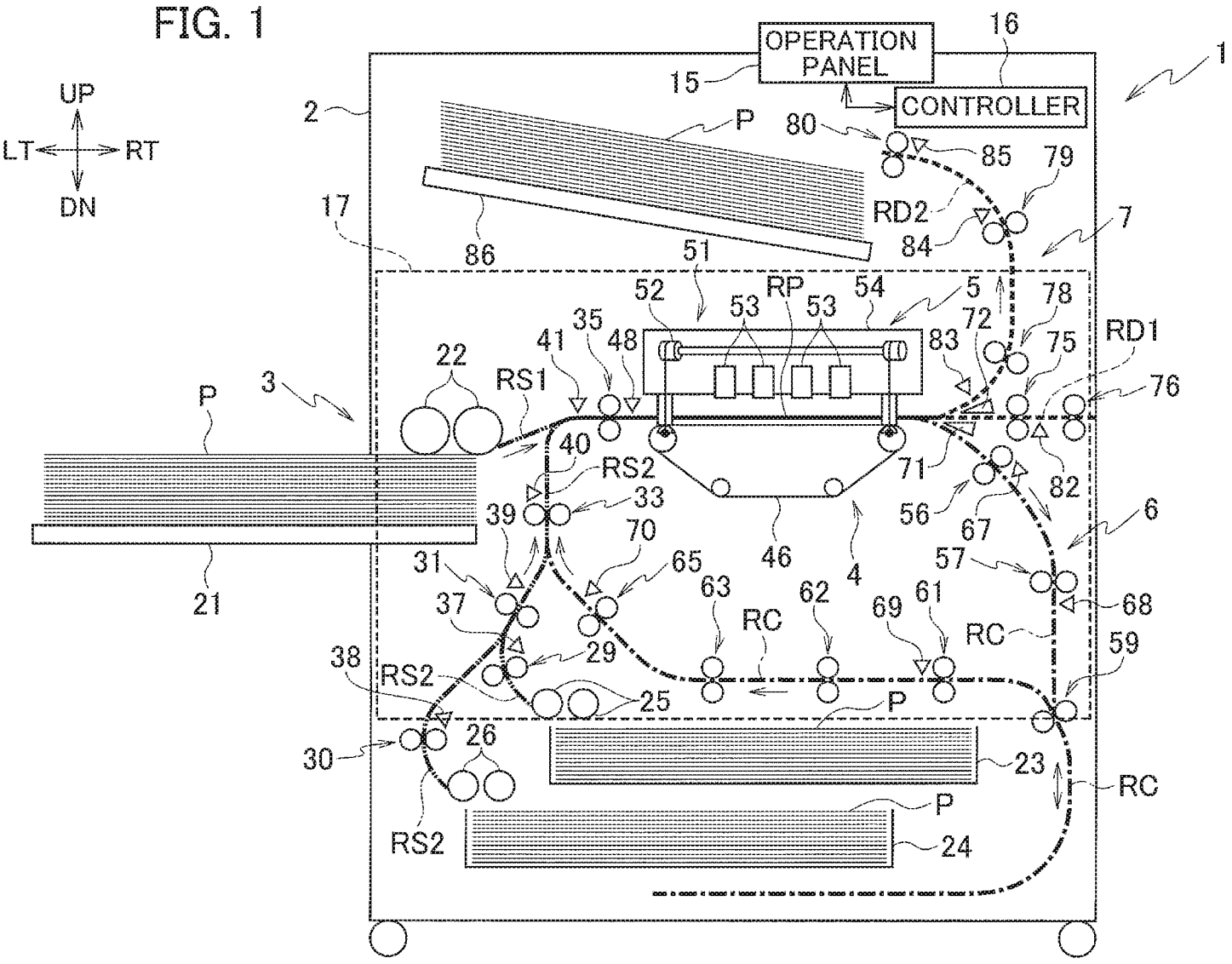
FIG. 1 is a schematic diagram illustrating the configuration of a printing apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
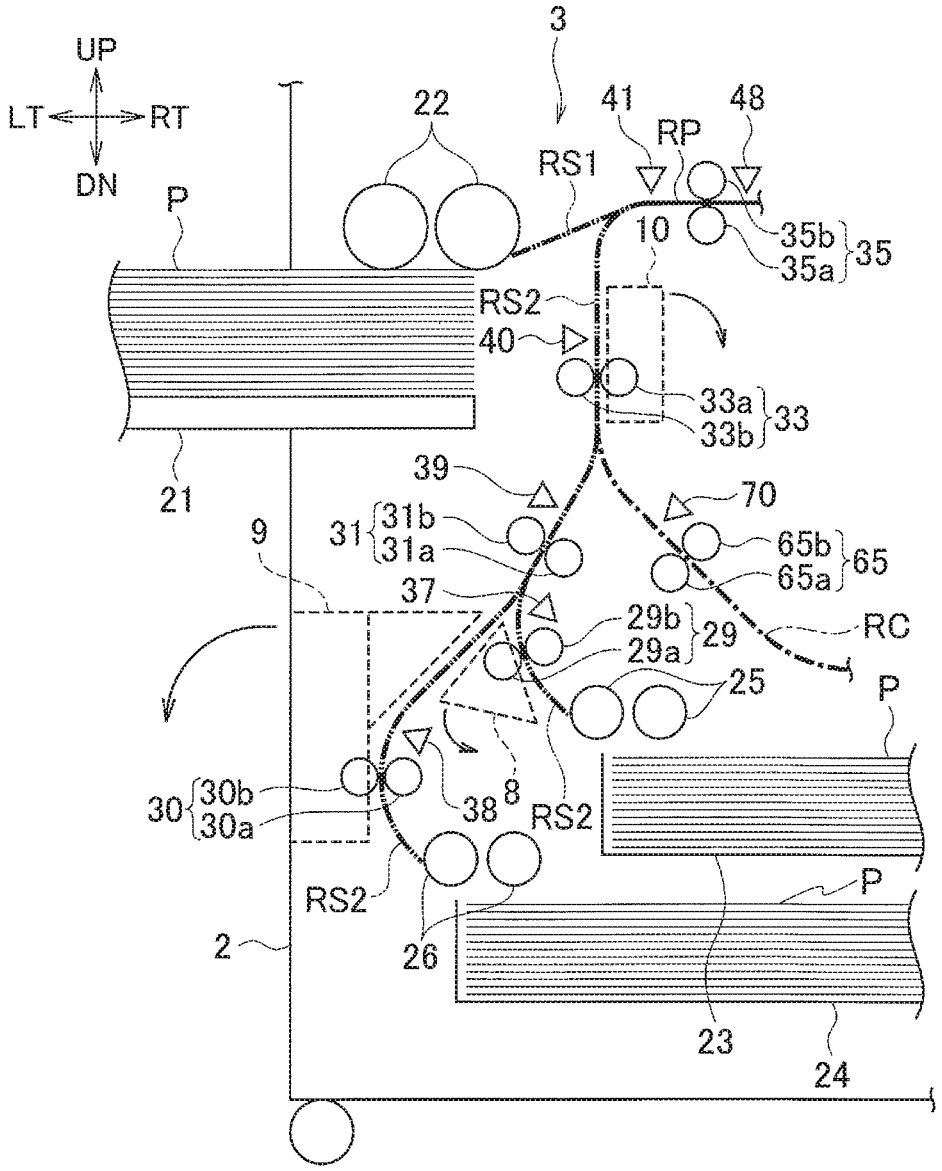
FIG. 2 is an enlarged view of an area around a sheet feeder of the printing apparatus shown in FIG. 1.
Figure 3:
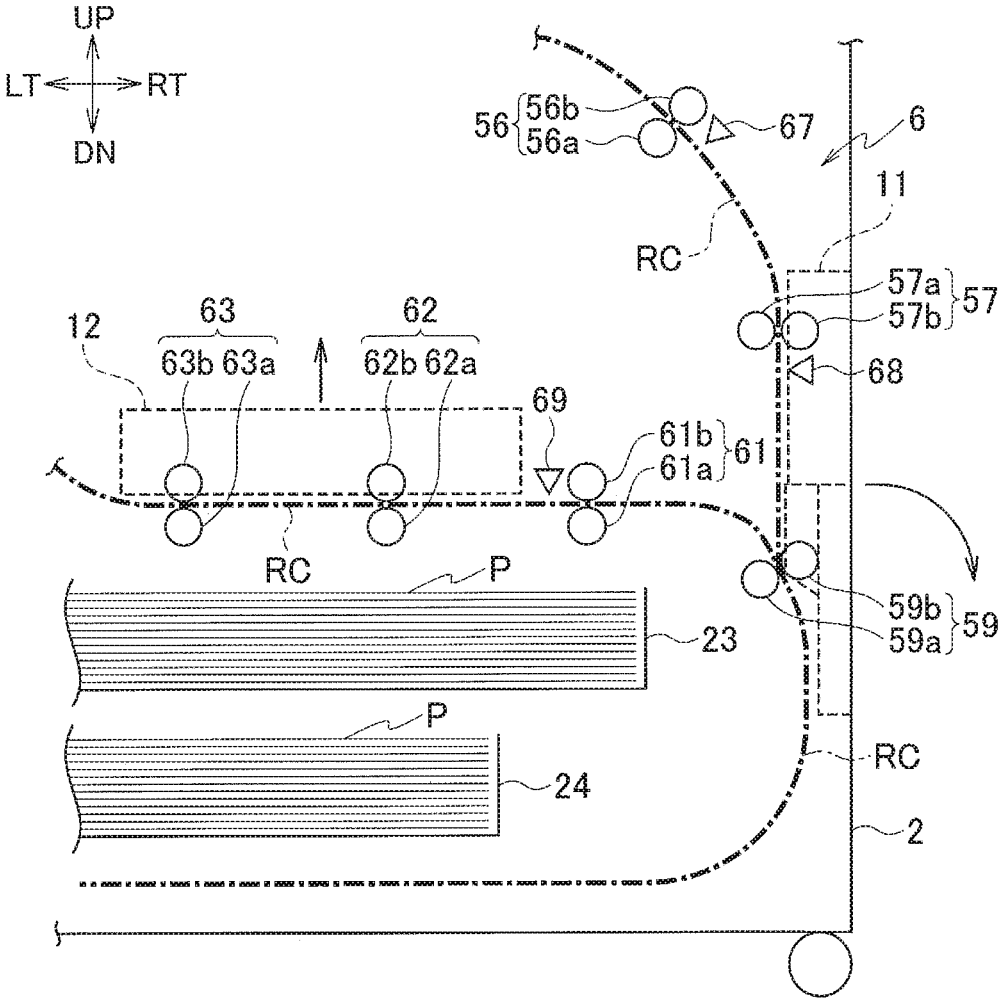
FIG. 3 is an enlarged view of an area around a circulation conveyor of the printing apparatus shown in FIG. 1.
Figure 4:
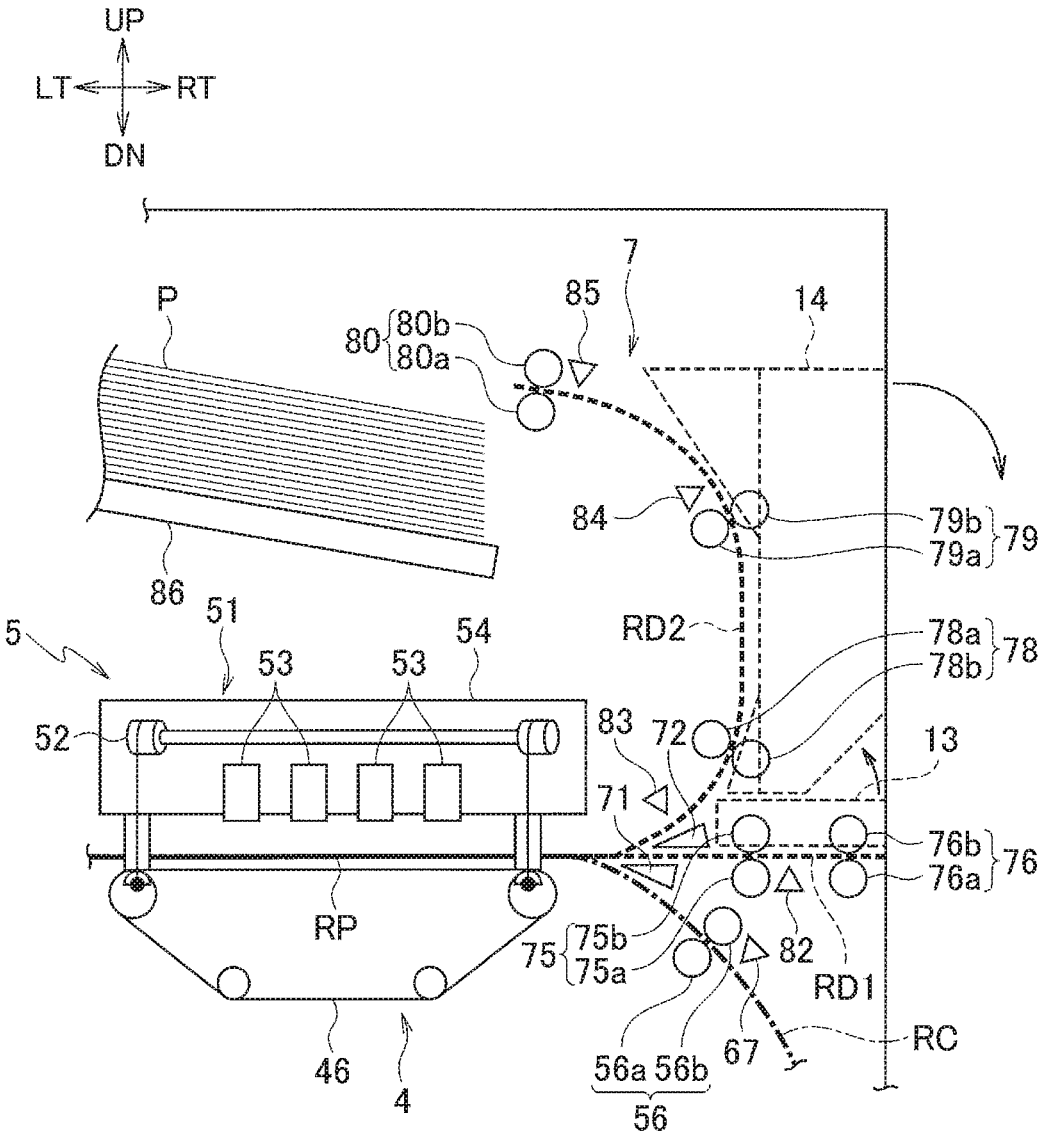
FIG. 4 is an enlarged view of an area around a sheet discharger of the printing apparatus shown in FIG. 1.
Figure 5:
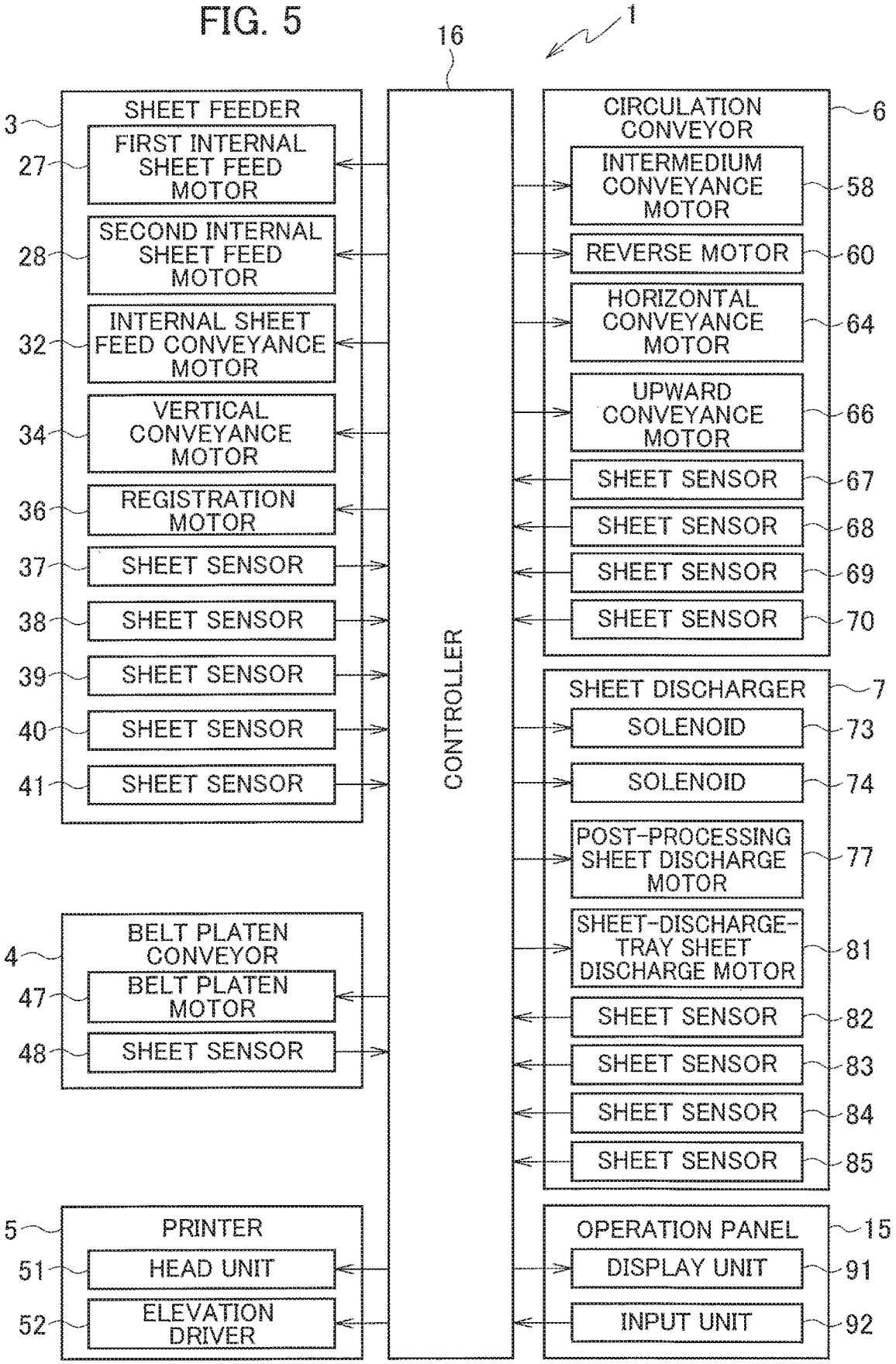
FIG. 5 is a control block diagram of the printing apparatus shown in FIG. 1.
Figure 6:
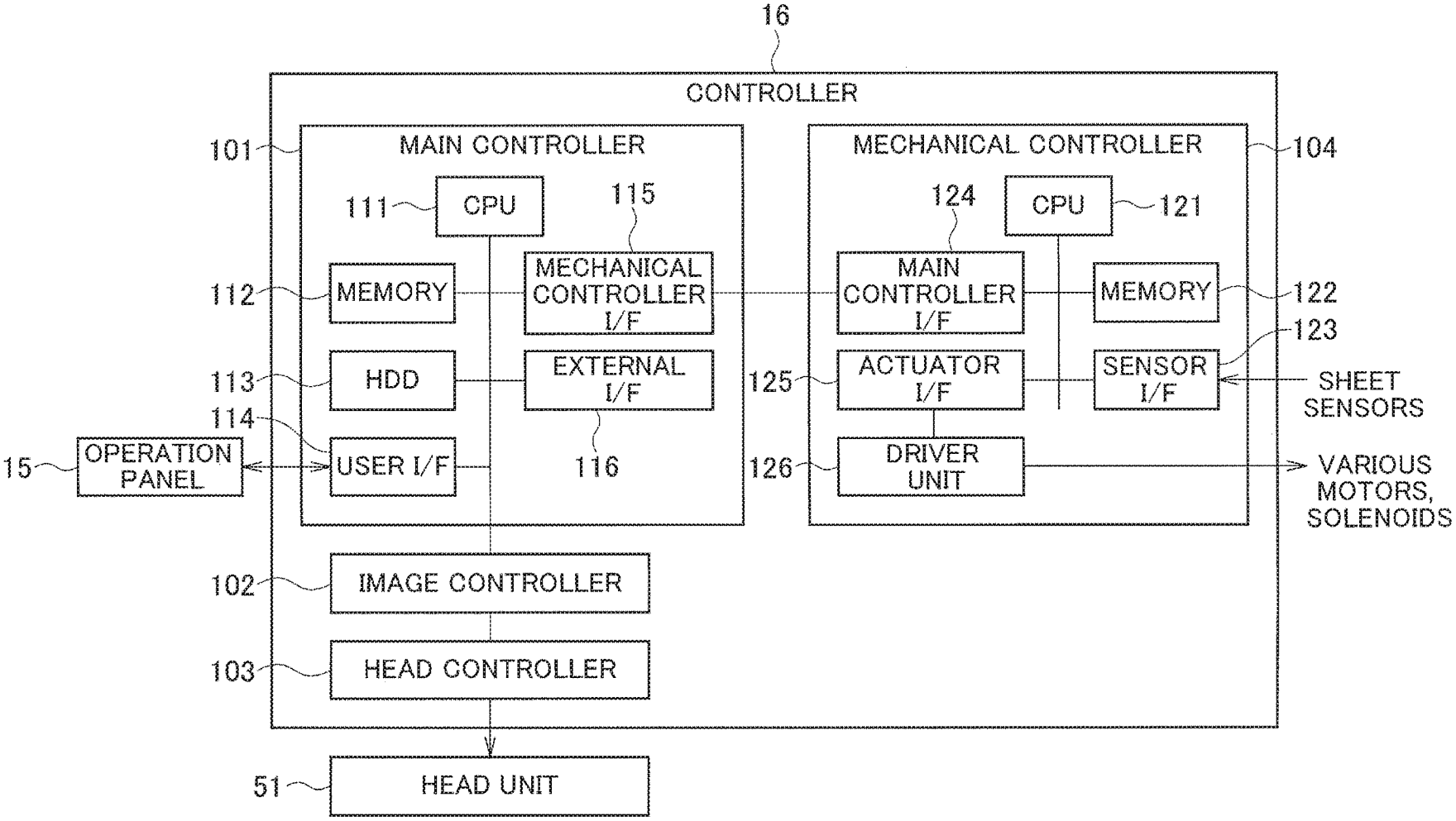
FIG. 6 is a block diagram illustrating the configuration of a controller of the printing apparatus shown in FIG. 1.

FIG. 1 is a schematic diagram illustrating the configuration of a printing apparatus 1 according to a first embodiment of the present invention. FIG. 2 is an enlarged view of an area around a sheet feeder 3 of the printing apparatus 1. FIG. 3 is an enlarged view of an area around a circulation conveyor 6 of the printing apparatus 1. FIG. 4 is an enlarged view of an area around a sheet discharger 7 of the printing apparatus 1. FIG. 5 is a control block diagram of the printing apparatus 1. FIG. 6 is a block diagram illustrating the configuration of a controller 16 of the printing apparatus 1. In the following description, orientations—up, down, left, and right—as viewed on the sheet plane of FIG. 1 correspond to upward, downward, leftward, and rightward directions referred to herein, and a direction orthogonal to the sheet plane of FIG. 1 corresponds to a front-rear direction. In FIGS. 1 to 4, the rightward direction, the leftward direction, the upward direction, and the downward direction are denoted as RT, LT, UP, and DN, respectively.

Routes indicated by thick lines in FIG. 1 are conveyance routes along which a sheet P, which is a print medium, is conveyed. Among the conveyance routes, a route indicated by a solid line is a print route RP, a route indicated by an alternate short and long dash line is a circulation route RC, routes indicated by broken lines are a first sheet discharge route RD1 and a second sheet discharge route RD2, routes indicated by two-dot chain lines are an external sheet feed route RS1 and an internal sheet feed route RS2. "Upstream" and "downstream" referred to in the following description mean upstream and downstream on a conveyance route.

As shown in FIGS. 1 to 5, the printing apparatus 1 according to the first embodiment includes a chassis 2, the sheet feeder 3, a belt platen conveyor 4, a printer 5, the circulation conveyor 6, the sheet discharger 7, jam release doors 8 to 14 (jam releasers), an operation panel 15, and the controller 16. The sheet feeder 3, the belt platen conveyor 4, the circulation conveyor 6, and the sheet discharger 7 form the conveyor.

The chassis 2 houses or holds the elements of the printing apparatus 1. The chassis 2 has a front cover 17. The front cover 17 opens and closes the front face of the chassis 2. By opening the front cover 17, a user can access the inside of the printing apparatus 1.

The sheet feeder 3 feeds an unprinted sheet P to the belt platen conveyor 4. In double-sided printing, the sheet feeder 3 re-feeds the sheet P printed on one side to the belt platen conveyor 4. The sheet feeder 3 includes an external sheet feed tray 21, external sheet feed rollers 22, first and second internal sheet feed trays 23 and 24, first and second internal sheet feed rollers 25 and 26, first and second internal sheet feed motors 27 and 28, first to third pairs of internal sheet feed conveyance rollers 29 to 31, an internal sheet feed conveyance motor 32, a pair of vertical conveyance rollers 33, a vertical conveyance motor 34, a pair of registration rollers 35, a registration motor 36, and sheet sensors 37 to 41. Note that the first to third pairs of internal sheet feed conveyance rollers 29 to 31, the pair of vertical conveyance rollers 33, and the pair of registration rollers 35 each correspond to a pair of conveyance rollers.

On the external sheet feed tray 21, sheets P to be used for printing are placed. The external sheet feed tray 21 is partially exposed to the outside of the chassis 2.

The external sheet feed rollers 22 pick up the sheets P stacked on the external sheet feed tray 21 one at a time, and convey the sheet P toward the pair of registration rollers 35 along the external sheet feed route RS1.

On the first and second internal sheet feed trays 23 and 24, sheets P used for printing are placed. The second internal sheet feed tray 24 is arranged below the first internal sheet feed tray 23. The first and second internal sheet feed trays 23 and 24 are arranged inside the chassis 2.

The first internal sheet feed rollers 25 pick up the sheets P stacked on the first internal sheet feed tray 23 one at a time, and convey the sheet P to the first pair of internal sheet feed conveyance rollers 29. The second internal sheet feed rollers 26 pick up the sheets P stacked on the second internal sheet feed tray 24 one at a time, and convey the sheet P to the second pair of internal sheet feed conveyance rollers 30.

The first internal sheet feed motor 27 and the second internal sheet feed motor 28 drive the first internal sheet feed rollers 25 and the second internal sheet feed rollers 26, respectively.

The first pair of internal sheet feed conveyance rollers 29 conveys the sheet P picked up by the first internal sheet feed rollers 25 from the first internal sheet feed tray 23 to the third pair of internal sheet feed conveyance rollers 31, and the second pair of internal sheet feed conveyance rollers 30 conveys the sheet P picked up by the second internal sheet feed rollers 26 from the second internal sheet feed tray 24 to the third pair of internal sheet feed conveyance rollers 31. The third pair of internal sheet feed conveyance rollers 31 conveys the sheet P conveyed thereto by the first pair of internal sheet feed conveyance rollers 29 or the second pair of internal sheet feed conveyance rollers 30 to the pair of vertical conveyance rollers 33. The third pair of internal sheet feed conveyance rollers 31 is arranged near and downstream of a point where part of the internal sheet feed route RS2 extending from the first internal sheet feed rollers 25 merges with part of the internal sheet feed route RS2 extending from the second internal sheet feed rollers 26.

The first pair of internal sheet feed conveyance rollers 29 is formed by a pair of a roller 29*a* and a roller 29*b*, and conveys a sheet P while nipping the sheet P with the rollers 29*a* and 29*b*. The second pair of internal sheet feed conveyance rollers 30 is formed by a pair of a roller 30*a* and a roller 30*b*, and conveys a sheet P while nipping the sheet P with the rollers 30*a* and 30*b*. The third pair of internal sheet feed conveyance rollers 31 is formed by a pair of a roller 31*a* and a roller 31*b*, and conveys a sheet P while nipping the sheet P with the rollers 31*a* and 31*b*.

The internal sheet feed conveyance motor 32 drives the first to third pairs of internal sheet feed conveyance rollers 29 to 31.

The pair of vertical conveyance rollers 33 conveys the sheet P conveyed thereto by the first to third pairs of internal sheet feed conveyance rollers 29 to 31 along the internal sheet feed route RS2, to the pair of registration rollers 35. Also, in double-sided printing, the pair of vertical conveyance rollers 33 conveys the sheet P printed on one side and conveyed thereto along the circulation route RC, to the pair of registration rollers 35. The pair of vertical conveyance rollers 33 is arranged along the internal sheet feed route RS2, downstream of a point where the circulation route RC merges with the internal sheet feed route RS2. The pair of vertical conveyance rollers 33 is formed by a pair of a roller 33*a* and a roller 33*b*, and conveys a sheet P while nipping the sheet P with the rollers 33*a* and 33*b*.

The vertical conveyance motor 34 drives the pair of vertical conveyance rollers 33. The vertical conveyance motor 34 also drives the external sheet feed rollers 22. The vertical conveyance motor 34 is connected to the pair of vertical conveyance rollers 33 and to the external sheet feed rollers 22 via one-way clutches. Thereby, the pair of vertical conveyance rollers 33 is driven when the vertical conveyance motor 34 is rotated in one direction, and the external sheet feed rollers 22 are driven when the vertical conveyance motor 34 is rotated in the other direction.

The pair of registration rollers 35 temporarily stops the sheet P conveyed thereto by the external sheet feed rollers 22 or by the pair of vertical conveyance rollers 33, corrects the skew of the sheet P, and then conveys the sheet P to the belt platen conveyor 4. The pair of registration rollers 35 is arranged on the print route RP, near and downstream of a point where the external sheet feed route RS1 and the internal sheet feed route RS2 merge. The pair of registration rollers 35 is formed by a pair of a roller 35*a* and a roller 35*b*, and conveys a sheet P while nipping the sheet P with the rollers 35*a* and 35*b*.

The registration motor 36 drives the pair of registration rollers 35.

The sheet sensor 37 detects a sheet P picked up from the first internal sheet feed tray 23 and conveyed to the third pair of internal sheet feed conveyance rollers 31. The sheet sensor 37 is arranged near and downstream of the first pair of internal sheet feed conveyance rollers 29. The sheet sensor 38 detects a sheet P picked up from the second internal sheet feed tray 24 and conveyed to the third pair of internal sheet feed conveyance rollers 31. The sheet sensor 38 is arranged near and downstream of the second pair of internal sheet feed conveyance rollers 30. The sheet sensor 39 detects a sheet P conveyed from the third pair of internal sheet feed conveyance rollers 31 to the pair of vertical conveyance rollers 33. The sheet sensor 39 is arranged near and downstream of the third pair of internal sheet feed conveyance rollers 31.

The sheet sensor 40 detects a sheet P conveyed from the pair of vertical conveyance rollers 33 to the pair of registration rollers 35. The sheet sensor 40 is arranged near and downstream of the pair of vertical conveyance rollers 33. The sheet sensor 41 detects a sheet P conveyed by the external sheet feed rollers 22 or by the pair of vertical conveyance rollers 33 and entering the pair of registration rollers 35. The sheet sensor 41 is arranged near and upstream of the pair of registration rollers 35.

The belt platen conveyor 4 conveys a sheet P conveyed thereto from the sheet feeder 3 to the circulation conveyor 6 or to the sheet discharger 7. The belt platen conveyor 4 is arranged downstream of the sheet feeder 3. The belt platen conveyor 4 includes a belt platen 46, a belt platen motor 47, and a sheet sensor 48.

The belt platen 46 conveys a sheet P conveyed thereto by the pair of registration rollers 35, while sucking and holding the sheet P on the belt. The belt platen 46 can be moved up and down by an elevation driver 52 to be described later.

The belt platen motor 47 drives the belt of the belt platen 46.

The sheet sensor 48 detects a sheet P conveyed from the pair of registration rollers 35 to the belt platen 46. The sheet sensor 48 is arranged between the pair of registration rollers 35 and the upstream end of the belt platen 46.

The printer 5 prints on a sheet P. The printer 5 is arranged above the belt platen 46. The printer 5 includes a head unit 51 and the elevation driver 52.

The head unit 51 prints an image on a sheet P by ejecting ink to the sheet P being conveyed by the belt platen 46. The head unit 51 includes a plurality of inkjet heads 53 and a head holder 54.

Each inkjet head 53 has a plurality of nozzles arranged in the front-rear direction (the main scanning direction), and ejects ink from the nozzles. The inkjet head 53 are arranged in parallel along the conveyance direction of the sheet P (the left-right direction).

The head holder 54 holds the inkjet heads 53. The head holder 54 is secured at a predetermined position in the chassis 2.

The elevation driver 52 moves the belt platen 46 up and down. The elevation driver 52 is arranged inside the head holder 54. The elevation driver 52 has a wire, a pulley, a motor, and the like, and supports the belt platen 46 suspended by the wire. The elevation driver 52 moves the belt platen 46 up and down by winding up or retrieving the wire by causing the motor to rotate the pulley.

The circulation conveyor 6 conveys, in double-sided printing, a sheet P printed on one side from the downstream end of the belt platen 46 to the pair of vertical conveyance rollers 33 along the circulation route RC. The circulation conveyor 6 includes first and second pairs of intermediate conveyance rollers 56 and 57, an intermediate conveyance motor 58, a pair of reverse rollers 59, a reverse motor 60, first to third pairs of horizontal conveyance rollers 61 to 63, a horizontal conveyance motor 64, a pair of upward conveyance rollers 65, an upward conveyance motor 66, and sheet sensors 67 to 70. Note that the first and second pairs of intermediate conveyance rollers 56 and 57, the pair of reverse rollers 59, the first to third pairs of horizontal conveyance rollers 61 to 63, and the pair of upward conveyance rollers 65 each correspond to a pair of conveyance rollers.

In double-sided printing, the first and second pairs of intermediate conveyance rollers 56 and 57 convey a sheet P printed on its front side to the pair of reverse rollers 59. The first and second pairs of intermediate conveyance rollers 56 and 57 are arranged along the circulation route RC between the belt platen 46 and the pair of reverse rollers 59.

The first pair of intermediate conveyance rollers 56 is formed by a pair of a roller 56*a* and a roller 56*b*, and conveys a sheet P while nipping the sheet P with the rollers 56*a* and 56*b*. The second pair of intermediate conveyance rollers 57 is formed by a pair of a roller 57*a* and a roller 57*b*, and conveys a sheet P while nipping the sheet P with the rollers 57*a* and 57*b*. The second pair of intermediate conveyance rollers 57 is arranged downstream of the first pair of intermediate conveyance rollers 56.

The intermediate conveyance motor 58 drives the first and second pairs of intermediate conveyance rollers 56 and 57. The intermediate conveyance motor 58 also drives a first pair of post-processing sheet discharge rollers 75 and first and second pairs of sheet-discharge-tray sheet discharge rollers 78 and 79 to be described later.

The pair of reverse rollers 59 reverses a sheet P conveyed by the first and second pairs of intermediate conveyance rollers 56 and 57 upside down by switchback, and conveys the reversed sheet P to the first pair of horizontal conveyance rollers 61. The pair of reverse rollers 59 is arranged along the circulation route RC, downstream of the second pair of intermediate conveyance rollers 57. The pair of reverse rollers 59 is formed by a pair of a roller 59*a* and a roller 59*b*, and conveys a sheet P while nipping the sheet P with the rollers 59*a* and 59*b*.

The reverse motor 60 drives the pair of reverse rollers 59.

The first to third pairs of horizontal conveyance rollers 61 to 63 convey a sheet P switched back by the pair of reverse rollers 59, to the pair of upward conveyance rollers 65. The first to third pairs of horizontal conveyance rollers 61 to 63 are arranged along an upstream part of the circulation route RC between the pair of reverse rollers 59 and a point where the circulation route RC merges with the internal sheet feed route S2.

The first pair of horizontal conveyance rollers 61 is formed by a pair of a roller 61*a* and a roller 61*b*, and conveys a sheet P while nipping the sheet P with the rollers 61*a* and 61*b*. The second pair of horizontal conveyance rollers 62 is formed by a pair of a roller 62*a* and a roller 62*b*, and conveys a sheet P while nipping the sheet P with the rollers 62*a* and 62*b*. The second pair of horizontal conveyance rollers 62 is arranged downstream of the first pair of horizontal conveyance rollers 61. The third pair of horizontal conveyance rollers 63 is formed by a pair of a roller 63*a* and a roller 63*b*, and conveys a sheet P while nipping the sheet P with the rollers 63*a* and 63*b*. The third pair of horizontal conveyance rollers 63 is arranged downstream of the second pair of horizontal conveyance rollers 62.

The horizontal conveyance motor 64 drives the first and second pairs of horizontal conveyance rollers 61 and 62. The third pair of horizontal conveyance rollers 63 is driven by the upward conveyance motor 66.

The pair of upward conveyance rollers 65 conveys a sheet P conveyed thereto by the first to third pairs of horizontal conveyance rollers 61 to 63 to the pair of vertical conveyance rollers 33. The pair of upward conveyance rollers 65 is arranged along a downstream part of the circulation route RC between the pair of reverse rollers 59 and a point where the circulation route RC merges with the internal sheet feed route RS2. The pair of upward conveyance rollers 65 is formed by a pair of a roller 65*a* and a roller 65*b*, and conveys a sheet P while nipping the sheet P with the rollers 65*a* and 65*b*.

The upward conveyance motor 66 drives the pair of upward conveyance rollers 65 and the third pair of horizontal conveyance rollers 63.

The sheet sensors 67 and 68 detect a sheet P conveyed by the first and second pairs of intermediate conveyance rollers 56 and 57 to the pair of reverse rollers 59. The sheet sensors 67 and 68 are arranged near and downstream of the first pair of intermediate conveyance rollers 56 and the second pair of intermediate conveyance rollers 57, respectively. The sheet sensors 69 and 70 detect a sheet P conveyed to the pair of vertical conveyance rollers 33 along the circulation route RC after being switched back by the pair of reverse rollers 59. The sheet sensors 69 and 70 are arranged near and downstream of the first pair of horizontal conveyance rollers 61 and the pair of upward conveyance rollers 65, respectively.

The sheet discharger 7 discharges a printed sheet P. The sheet discharger 7 includes switchers 71 and 72, solenoids 73 and 74, first and second pairs of post-processing sheet discharge rollers 75 and 76, a post-processing sheet discharge motor 77, first to third pairs of sheet-discharge-tray sheet discharge rollers 78 to 80, a sheet-discharge-tray sheet discharge motor 81, sheet sensors 82 to 85, and a sheet discharge tray 86. The first and second pairs of post-processing sheet discharge rollers 75 and 76 and the first to third pairs of sheet-discharge-tray sheet discharge rollers 78 to 80 each correspond to the pair of conveyance rollers.

The switcher 71 switches the conveyance route for a sheet P between the first sheet discharge route RD1 and the circulation route RC. The first sheet discharge route RD1 extends from the downstream end of the print route RP towards a post-processing device (not shown) arranged on the right side of the printing apparatus 1. The switcher 71 is arranged at a branch point between the first sheet discharge route RD1 and the circulation route RC.

The switcher 72 switches the conveyance route for a sheet P between the first sheet discharge route RD1 and the second sheet discharge route RD2. The second sheet discharge route RD2 extends toward the sheet discharge tray 86 after branching off from the first sheet discharge route RD1 at a location downstream of the branch point between the first sheet discharge route RD1 and the circulation route RC. The switcher 72 is arranged at a branch point where the second sheet discharge route RD2 branches off from the first sheet discharge route RD1.

The solenoids 73 and 74 drive the switchers 71 and 72, respectively.

The first and second pairs of post-processing sheet discharge rollers 75 and 76 discharge a sheet P conveyed thereto from the belt platen 46 to the post-processing device. The first and second pairs of post-processing sheet discharge rollers 75 and 76 are arranged along the first sheet discharge route RD1.

The first pair of post-processing sheet discharge rollers 75 is formed by a pair of a roller 75*a* and a roller 75*b*, and conveys a sheet P while nipping the sheet P with the rollers 75*a* and 75*b*. The second pair of post-processing sheet discharge rollers 76 is formed by a pair of a roller 76*a* and a roller 76*b*, and conveys a sheet P while nipping the sheet P with the rollers 76*a* and 76*b*. The second pair of post-processing sheet discharge rollers 76 is arranged downstream of the first pair of post-processing sheet discharge rollers 75.

The post-processing sheet discharge motor 77 drives the second pair of post-processing sheet discharge rollers 76. The first pair of post-processing sheet discharge rollers 75 is driven by the intermediate conveyance motor 58.

The first to third pairs of sheet-discharge-tray sheet discharge rollers 78 to 80 discharge a sheet P conveyed thereto from the belt platen 46 to the sheet discharge tray 86. The first to third pairs of sheet-discharge-tray sheet discharge rollers 78 to 80 are arranged along the second sheet discharge route RD2.

The first pair of sheet-discharge-tray sheet discharge rollers 78 is formed by a roller 78*a* and a roller 78*b*, and conveys a sheet P while nipping the sheet P with the rollers 78*a* and 78*b*. The second pair of sheet-discharge-tray sheet discharge rollers 79 is formed by a roller 79*a* and a roller 79*b*, and conveys a sheet P while nipping the sheet P with the rollers 79*a* and 79*b*. The second pair of sheet-discharge-tray sheet discharge rollers 79 is arranged downstream of the first pair of sheet-discharge-tray sheet discharge rollers 78. The third pair of sheet-discharge-tray sheet discharge rollers 80 is formed by a roller 80*a* and a roller 80*b*, and conveys a sheet P while nipping the sheet P with the rollers 80*a* and 80*b*. The third pair of sheet-discharge-tray sheet discharge rollers 80 is arranged downstream of the second pair of sheet-discharge-tray sheet discharge rollers 79.

The sheet-discharge-tray sheet discharge motor 81 drives the third pair of sheet-discharge-tray sheet discharge rollers 80. The first and second pairs of sheet-discharge-tray sheet discharge rollers 78 and 79 are driven by the intermediate conveyance motor 58.

The sheet sensor 82 detects a sheet P conveyed along the first sheet discharge route RD1. The sheet sensor 82 is arranged near and downstream of the first pair of post-processing sheet discharge rollers 75. The sheet sensors 83 to 85 detect a sheet P conveyed along the second sheet discharge route RD2. The sheet sensor 83 is arranged between the point where the second sheet discharge route RD2 branches off from the first sheet discharge route RD1 and the first pair of sheet-discharge-tray sheet discharge rollers 78. The sheet sensor 84 is arranged near and downstream of the second pair of sheet-discharge-tray sheet discharge rollers 79. The sheet sensor 85 is arranged near and upstream of the third pair of sheet-discharge-tray sheet discharge rollers 80.

On the sheet discharge tray 86, a sheet P discharged by the first to third pairs of sheet-discharge-tray sheet discharge rollers 78 to 80 is placed. The sheet discharge tray 86 is arranged downstream of the second sheet discharge route RD2.

The jam release doors 8 to 14 enable a user to access the conveyance routes for jam release work performed after a jam of a sheet P occurs. The jam release doors 8 to 14 are opened and closed by a user.

The jam release door 8 enables a user to access an area around the first pair of internal sheet feed conveyance rollers 29. The roller 29*b* of the first pair of internal sheet feed conveyance rollers 29 is attached to the jam release door 8, so that the jam release door 8 separates the roller 29*b* from the roller 29*a* when opened.

The jam release door 9 enables a user to access an area around the second pair of internal sheet feed conveyance rollers 30. The roller 30*b* of the second pair of internal sheet feed conveyance rollers 30 is attached to the jam release door 9, so that the jam release door 9 separates the roller 30*b* from the roller 30*a* when opened.

The jam release door 10 enables a user to access an area around the pair of vertical conveyance rollers 33. The roller 33*b* of the pair of vertical conveyance rollers 33 is attached to the jam release door 10, so that the jam release door 10 separates the roller 33*b* from the roller 33*a* when opened.

The jam release door 11 enables a user to access an area around the second pair of intermediate conveyance rollers 57 and the pair of reverse rollers 59. The roller 57*b* of the second pair of intermediate conveyance rollers 57 and the roller 59*b* of the pair of reverse rollers 59 are attached to the jam release door 11, so that the jam release door 11, when opened, separates the roller 57*b* of the second pair of intermediate conveyance rollers 57 from the roller 57*a* and separates the roller 59*b* of the pair of reverse rollers 59 from the roller 59*a*.

When the jam release door 11 is opened with a sheet P nipped only by either or both of the second pair of intermediate conveyance rollers 57 and the pair of reverse rollers 59 which are pairs of conveyance rollers associated with the jam release door 11 (i.e., only by the second pair of intermediate conveyance rollers 57 and the pair of reverse rollers 59, only by the second pair of intermediate conveyance rollers 57, or only by the pair of reverse rollers 59), the sheet P falls due to the release of the nip. Then, the sheet P falls to a space under the second internal sheet feed tray 24 along the circulation route RC. The space under the second internal sheet feed tray 24 is a place without a mechanism for taking out the sheet P. To take out the sheet P from this place, the user needs to dismount the second internal sheet feed tray 24, which is extra work. The jam release door 11 corresponds to the first jam releaser.

The jam release door 12 enables a user to access an area around the second and third pairs of horizontal conveyance rollers 62 and 63. The roller 62*b* of the second pair of horizontal conveyance rollers 62 and the roller 63*b* of the third pair of horizontal conveyance rollers 63 are attached to the jam release door 12, so that the jam release door 12, when opened, separates the roller 62*b* of the second pair of horizontal conveyance rollers 62 from the roller 62*a* and separates the roller 63*b* of the third pair of horizontal conveyance rollers 63 from the roller 63*a*.

The jam release door 13 enables a user to access an area around the first and second pairs of post-processing sheet discharge rollers 75 and 76. The roller 75*b* of the first pair of post-processing sheet discharge rollers 75 and the roller 76*b* of the second pair of post-processing sheet discharge rollers 76 are attached to the jam release door 13, so that the jam release door 13, when opened, separates the roller 75*b* of the first pair of post-processing sheet discharge rollers 75 from the roller 75*a* and separates the roller 76*b* of the second pair of post-processing sheet discharge rollers 76 from the roller 76*a*.

The jam release door 14 enables a user to access an area around the first and second pairs of sheet-discharge-tray sheet discharge rollers 78 and 79. The roller 78*b* of the first pair of sheet-discharge-tray sheet discharge rollers 78 and the roller 79*b* of the second pair of sheet-discharge-tray sheet discharge rollers 79 are attached to the jam release door 14, so that the jam release door 14, when opened, separates the roller 78*b* of the first pair of sheet-discharge-tray sheet discharge rollers 78 from the roller 78*a* and separates the roller 79*b* of the second pair of sheet-discharge-tray sheet discharge rollers 79 from the roller 79*a*.

The operation panel 15 displays various input screens and the like, and receives input operations from a user. The operation panel 15 includes a display 91 and an input unit 92.

The display 91 displays various input screens and the like. The display 91 has a liquid crystal display panel and the like.

The input unit 92 receives input operations by a user and outputs operation signals according to the operations. The input unit 92 has various operation keys, a touch panel, and/or the like.

The controller 16 controls the overall operation of the printing apparatus 1. As illustrated in FIG. 6, the controller 16 includes a main controller 101, an image controller 102, a head controller 103, and a mechanical controller 104.

The main controller 101 takes overall control of the printing apparatus 1. The main controller 101 includes a central processing unit (CPU) 111, a memory 112, a hard disk drive (HDD) 113, a user interface (I/F) 114, a mechanical controller I/F 115, and an external I/F 116.

The CPU 111 executes computation processing. The memory 112 is used by the CPU 111 as a work area for temporary storage of data and computation. The HDD 113 stores various programs and the like. The user I/F 114 connects the operation panel 15 to the main controller 101. The mechanical controller I/F 115 connects the mechanical controller 104 to the main controller 101. The external I/F 116 transmits and receives data to and from an external device via a network.

The image controller 102 performs predetermined image processing on image data to be printed. The head controller 103 controls the driving of each inkjet head 53 of the head unit 51 based on image data.

The mechanical controller 104 controls sheet conveyance by the sheet feeder 3, the belt platen conveyor 4, the circulation conveyor 6, and the sheet discharger 7. The mechanical controller 104 includes a CPU 121, a memory 122, a sensor I/F 123, a main controller I/F 124, an actuator I/F 125, and a driver unit 126.

The CPU 121 executes computation processing. The memory 122 is used by the CPU 121 as a work area for temporary storage of data and computation. The sensor I/F 123 connects the sheet sensors to the mechanical controller 104. The main controller I/F 124 connects the mechanical controller 104 to the main controller 101. The actuator I/F 125 transmits control signals to the driver unit 126. The driver unit 126 has various drivers that drive the motors, such as the first internal sheet feed motor 27, and solenoids 73 and 74.

When a jam of a sheet P occurs during double-sided printing operation, the mechanical controller 104 controls the sheet feeder 3, the belt platen conveyor 4, the circulation conveyor 6, and the sheet discharger 7 to stop sheet conveyance. In stopping the sheet conveyance upon the occurrence of a jam during double-sided printing operation, the mechanical controller 104 controls the sheet conveyance to ensure that a sheet P not causing the jam does not stop while nipped only by either or both of the second pair of intermediate conveyance rollers 57 and the pair of reverse rollers 59.

Next, a description is given of how the printing apparatus 1 operates.

Upon input of a print job, the CPU 111 of the main controller 101 divides the print job into image data and job data. The job data contains information such as the number of sheets to be printed and the sheet size. The CPU 111 transmits the image data to the image controller 102 and the job data to the mechanical controller 104.

Upon receipt of the job data, the mechanical controller 104 controls the sheet feeder 3, the belt platen conveyor 4, the circulation conveyor 6, and the sheet discharger 7 so that a sheet P may be fed, conveyed, and discharged.

Meanwhile, the image controller 102 performs predetermined image processing on the image data, and then outputs the image data to the head controller 103. Based on the image data, the head controller 103 controls the inkjet heads 53 so that they print an image on a sheet P by ejecting ink to the sheet P conveyed by the belt platen 46.

In single-sided printing, the sheet feeder 3 sequentially picks up unprinted sheets P from one of the external sheet feed tray 21, the first internal sheet feed tray 23, and the second internal sheet feed tray 24, and feeds the sheets P sequentially at appropriate timing so that the sheets P will be conveyed on the belt platen 46 at predetermined sheet intervals. The sheet P thus fed is printed by the ink ejected from the inkjet heads 53 while conveyed on the belt platen 46 at a predetermined print conveyance speed. The printed sheet P is then discharged by the sheet discharger 7.

When the sheet discharge destination is the post-processing device, the printed sheet P is guided by the switchers 71 and 72 to the first sheet discharge route RD1. The sheet P is then discharged to the post-processing device by the first and second pairs of post-processing sheet discharge rollers 75 and 76. When the sheet discharge destination is the sheet discharge tray 86, the printed sheet P is guided by the switchers 71 and 72 to the second sheet discharge route RD2. The sheet P is then discharged to the sheet discharge tray 86 by the first to third pairs of sheet-discharge-tray sheet discharge rollers 78 to 80.

In double-sided printing, the sheet feeder 3 sequentially feeds unprinted sheets P at timing such that the period of time between the timings for feeding sheets P is twice as long as that in single-sided printing. The sheet P thus fed is, as in single-sided printing, printed while conveyed on the belt platen 46.

The sheet P printed on one side is guided by the switcher 71 to the circulation route RC, and is conveyed to the pair of reverse rollers 59 by the first and second pairs of intermediate conveyance rollers 56 and 57. Arriving at the pair of reverse rollers 59, the sheet P is switched back by the pair of reverse rollers 59. The sheet P is next conveyed to the pair of vertical conveyance rollers 33 by the first to third pairs of horizontal conveyance rollers 61 to 63 and the pair of upward conveyance rollers 65. The sheet P is then re-fed to the belt platen 46 by the pair of vertical conveyance rollers 33 and the pair of registration rollers 35.

In this respect, the sheets P printed on one side are re-fed with such timing that they are sent to the belt platen 46 alternately with unprinted sheets P being fed sequentially. As mentioned earlier, the period of time between timings for feeding sheets P in double-sided printing is twice as long as that in single-sided printing. Thus, the sheets P printed on one side can be re-fed alternately with unprinted sheets P by being inserted between unprinted sheets P.

Being switched back by the pair of reverse rollers 59, the sheet P printed on one side is sent to the belt platen 46 with its unprinted side facing upward. The sheet P printed on one side is now printed on its unprinted side while being conveyed on the belt platen 46. The sheet P thus printed on both sides is discharged to the post-processing device or the sheet discharge tray 86 by the sheet discharger 7.

As described above, in double-sided printing, feeding of an unprinted sheet P and re-feeding of a sheet P printed on one side are performed alternately, so that printing on one side of the unprinted sheet P and printing on an unprinted side of the sheet P already printed on one side are performed alternately. Thereby, productivity per side in double-sided printing is equivalent to that in single-sided printing.

Next, the above-described operation performed when a jam occurs during double-sided printing is described with reference to a flowchart in FIG. 7.

Figure 7:
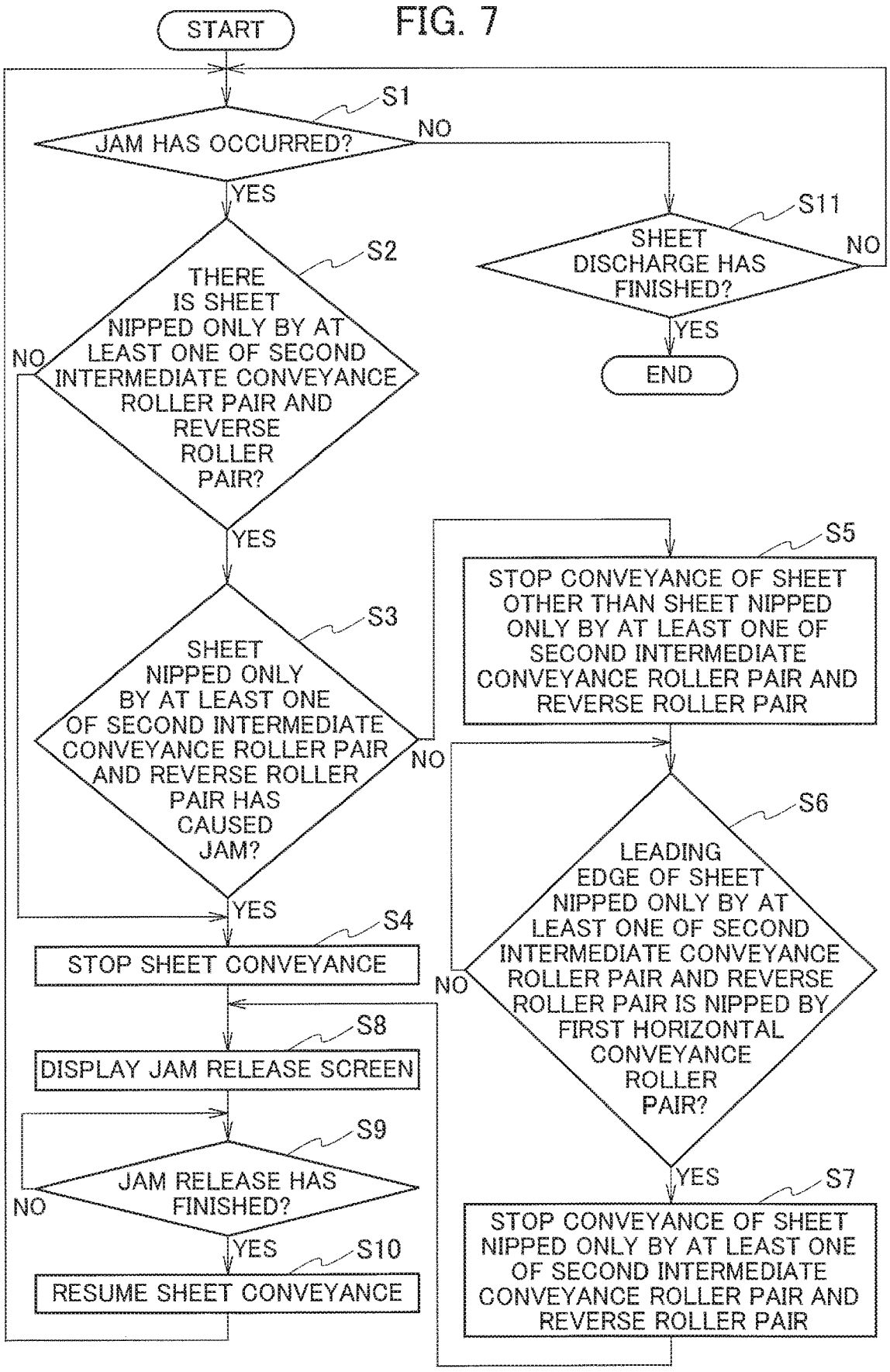
FIG. 7 is a flowchart illustrating how the printing apparatus according to the first embodiment operates when a jam occurs during double-sided printing.

The processing of the flowchart in FIG. 7 is started when sheet feed and conveyance for double-sided printing is started.

In Step S1 in FIG. 7, the mechanical controller 104 determines whether a jam of a sheet P has occurred. The mechanical controller 104 determines that a jam has occurred when an error between timing of detection by at least one of the sheet sensors 37 to 41, 48, 67 to 70, and 82 to 85 and its theoretical value is equal to or above a threshold.

When determining that a jam has occurred (Step S1:YES), in Step S2 the mechanical controller 104 determines whether there is a sheet P nipped only by either or both of the second pair of intermediate conveyance rollers 57 and the pair of reverse rollers 59 at the time of the occurrence of the jam. The mechanical controller 104 determines whether there is a sheet P nipped only by either or both of the second pair of intermediate conveyance rollers 57 and the pair of reverse rollers 59 at the time of the occurrence of the jam, based on whether the sheet sensors 67 to 69 detect a sheet at the time of the occurrence of the jam and on the differences in time between the sheet detection by the sheet sensors 67 and 68 and the occurrence of the jam.

When determining that there is a sheet P nipped only by either or both of the second pair of intermediate conveyance rollers 57 and the pair of reverse rollers 59 (Step S2:YES), in Step S3 the mechanical controller 104 determines whether this sheet P is causing the jam. The mechanical controller 104 can determine which of the sheets P on the conveyance route is causing the jam, by detecting which sheet sensor has detected the jam.

When determining that the sheet P nipped only by either or both of the second pair of intermediate conveyance rollers 57 and the pair of reverse rollers 59 is causing the jam (Step S3:YES), in Step S4 the mechanical controller 104 stops sheet conveyance. More specifically, the mechanical controller 104 stops operations of the sheet feeder 3, the belt platen conveyor 4, the circulation conveyor 6, and the sheet discharger 7.

When determining in Step S2 that there is no sheet P nipped only by either or both of the second pair of intermediate conveyance rollers 57 and the pair of reverse rollers 59 at the time of the occurrence of the jam (Step S2:NO), the mechanical controller 104 skips Step S3 and proceeds to Step S4 to stop sheet conveyance.

When determining in Step S3 that the sheet P nipped only by either or both of the second pair of intermediate conveyance rollers 57 and the pair of reverse rollers 59 is not causing the jam (Step S3:NO), in Step S5 the mechanical controller 104 stops conveyance of a sheet P other than the sheet P nipped only by either or both of the second pair of intermediate conveyance rollers 57 and the pair of reverse rollers 59. Meanwhile, the mechanical controller 104 continues the conveyance of the sheet P nipped only by either or both of the second pair of intermediate conveyance rollers 57 and the pair of reverse rollers 59.

Next, in Step S6, the mechanical controller 104 determines whether the leading edge of the sheet P nipped only by either or both of the second pair of intermediate conveyance rollers 57 and the pair of reverse rollers 59 at the time of the occurrence of the jam is nipped by the first pair of horizontal conveyance rollers 61. The mechanical controller 104 determines that the leading edge of the sheet P nipped only by either or both of the second pair of intermediate conveyance rollers 57 and the pair of reverse rollers 59 at the time of the occurrence of the jam is nipped by the first pair of horizontal conveyance rollers 61 when the sheet sensor 69 detects the leading edge of this sheet P.

When determining that the leading edge of the sheet P nipped only by either or both of the second pair of intermediate conveyance rollers 57 and the pair of reverse rollers 59 at the time of the occurrence of the jam is yet to be nipped by the first pair of horizontal conveyance rollers 61 (Step S6:NO), the mechanical controller 104 repeats Step S6.

When determining that the leading edge of the sheet P nipped only by either or both of the second pair of intermediate conveyance rollers 57 and the pair of reverse rollers 59 at the time of the occurrence of the jam is nipped by the first pair of horizontal conveyance rollers 61 (Step S6:YES), in Step S7 the mechanical controller 104 stops conveyance of this sheet P.

In this way, sheet conveyance is controlled to ensure that the sheet P not causing the jam does not stop while nipped only by either or both of the second pair of intermediate conveyance rollers 57 and the pair of reverse rollers 59.

If the sheet P nipped only by either or both of the second pair of intermediate conveyance rollers 57 and the pair of reverse rollers 59 is a sheet P causing the jam (Step S3:YES), the sheet P is possibly immovable. Trying to move such a sheet P may, for example, cause the sheet P to be bellow-shaped, and this may aggravate the damage by the jam. Thus, sheet conveyance is stopped altogether in this case.

When sheet conveyance is stopped in Step S4 or Step S7, in Step S8 the main controller 101 displays a jam release screen (not shown) on the display 91. The jam release screen prompts the user to remove the sheets P remaining on the conveyance routes. The jam release screen instructs the user to open the necessary one or ones of the front cover 17 and the jam release doors 8 to 14 and remove the sheets P. Seeing the jam release screen, the user performs jam release work to remove the sheet P remaining on the conveyance routes.

Figure 8:
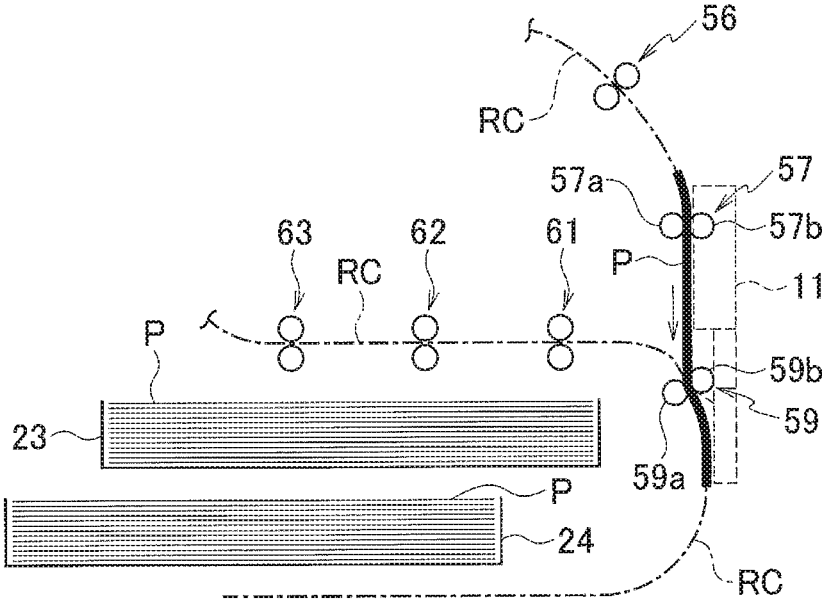
FIG. 8 is a diagram illustrating sheet conveyance stop control performed when a jam occurs.
Figure 9:
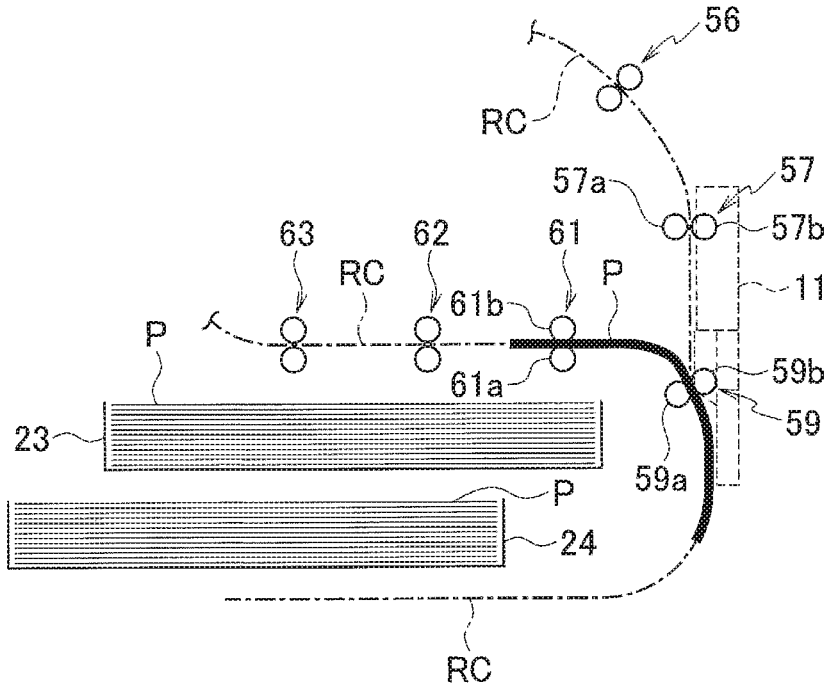
FIG. 9 is a diagram illustrating the sheet conveyance stop control performed when a jam occurs.

Assume that there is a sheet P nipped only by the second pair of intermediate conveyance rollers 57 and the pair of reverse rollers 59 at the time of the occurrence of a jam as illustrated in FIG. 8, and that the sheet P is not causing the jam. Then, as illustrated in FIG. 9, the sheet P nipped only by the second pair of intermediate conveyance rollers 57 and the pair of reverse rollers 59 at the time of the occurrence of the jam is stopped when its leading edge is nipped by the first pair of horizontal conveyance rollers 61.

Figure 10:
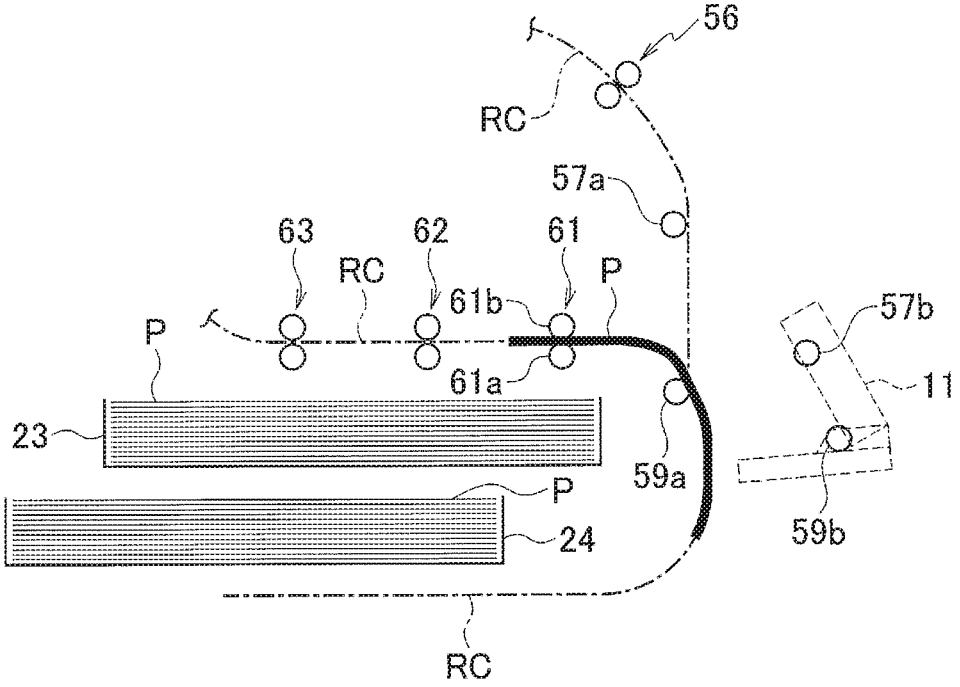
FIG. 10 is a diagram illustrating the state where a jam release door associated with a second pair of intermediate conveyance rollers and a pair of reverse rollers is open.

When the jam release door 11 is opened in the above state for jam release work as illustrated in FIG. 10, the rollers 57*a* and 57*b* of the second pair of intermediate conveyance rollers 57 separate from each other, and the rollers 59*a* and 59*b* of the pair of reverse rollers 59 also separate from each other. However, the sheet P does not fall because the sheet P is nipped by the first pair of horizontal conveyance rollers 61.

The rollers 61*a* and 61*b* of the first pair of horizontal conveyance rollers 61 are in constant contact with each other. In other words, no matter which jam release door is opened, the rollers 61*a* and 61*b* of the first pair of horizontal conveyance rollers 61 do not separate from each other. Thus, even if any other jam release door is opened with the jam release door 11 open, the sheet P does not fall since the nip by the first pair of horizontal conveyance rollers 61 is not released.

Figure 11:
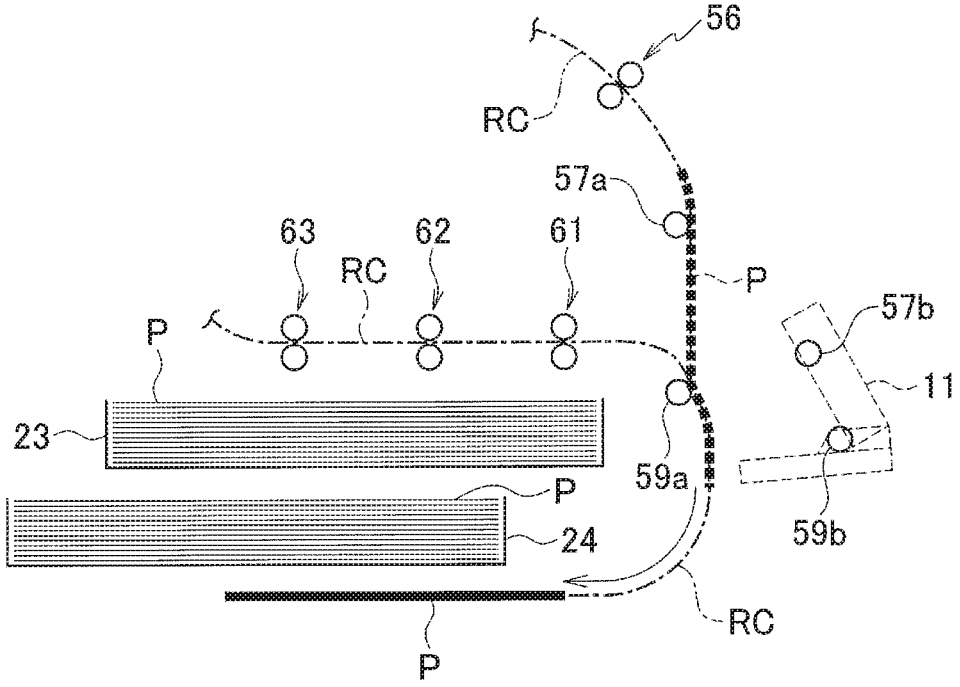
FIG. 11 RELATED ART
FIG. 11 illustrates a printing apparatus of a related art, showing how a sheet falls when a jam release door associated with a second pair of intermediate conveyance rollers and a pair of reverse rollers is opened.

Now assume that, unlike the present embodiment, sheet conveyance is stopped altogether upon the occurrence of a jam even though a sheet P is nipped only by the second pair of intermediate conveyance rollers 57 and the pair of reverse rollers 59 at the time of the occurrence of the jam as illustrated in FIG. 8 and is nota sheet P causing the jam. If the jam release door 11 is opened in this case as illustrated in FIG. 11, the nip by the second pair of intermediate conveyance rollers 57 and the nip by the pair of reverse rollers 59 are released, causing the sheet P to fall to the space under the second internal sheet feed tray 24. To remove the sheet P fallen to this place, the user needs to dismount the second internal sheet feed tray 24.

As described earlier, if the sheet P causing a jam is nipped only by either or both of the second pair of intermediate conveyance rollers 57 and the pair of reverse rollers 59 at the time of the occurrence of the jam, sheet conveyance is stopped altogether. When the jam release door 11 is opened in this case, the sheet P nipped only by either or both of the second pair of intermediate conveyance rollers 57 and the pair of reverse rollers 59 falls to the space under the second internal sheet feed tray 24 by the release of the nip. The user then needs to dismount the second internal sheet feed tray 24 to remove the sheet P.

Referring back to FIG. 7, in Step S9 the mechanical controller 104 determines whether the jam release work has finished. The mechanical controller 104 determines that the jam release work has finished if any one or ones of the front cover 17 and the jam release doors 8 to 14 opened for the jam release are closed. Opening and closing of the front cover 17 and the jam release doors 8 to 14 can be detected by sensors (not shown). When determining that the jam release work has not finished yet (Step S9: NO), the mechanical controller 104 repeats Step S9.

When determining that the jam release work has finished (Step S9: YES), in Step S10 the mechanical controller 104 resumes sheet conveyance. The mechanical controller 104 then proceeds back to Step S1.

When determining in Step S1 that a jam has not occurred (Step S1: NO), in Step S11 the mechanical controller 104 determines whether discharge of sheets equaling the number of sheets to be printed has finished. When determining that discharge of sheets equaling the number of sheets to be printed has not finished yet (Step S11: NO), the mechanical controller 104 proceeds back to Step S1. When the mechanical controller 104 determines that discharge of sheets equaling the number of sheets to be printed has finished (Step S11: YES), the series of operation ends.

According to the printing apparatus 1 as described above, in stopping sheet conveyance upon the occurrence of a jam during double-sided printing, the mechanical controller 104 controls the sheet conveyance to ensure that a sheet P not causing the jam does not stop while nipped only by either or both of the second pair of intermediate conveyance rollers 57 and the pair of reverse rollers 59. More specifically, when a sheet P is nipped only by either or both of the second pair of intermediate conveyance rollers 57 and the pair of reverse rollers 59 at the time of the occurrence of the jam and is not a sheet P causing the jam, the mechanical controller 104 continues conveyance of the sheet P and then stops the conveyance of the sheet P when the sheet P is nipped by the first pair of horizontal conveyance rollers 61.

This makes it less likely that the sheet P not causing the jam falls to the space under the second internal sheet feed tray 24 when the jam release door 11 is opened for jam release work. As a result, sheets P that fall to the space under the second internal sheet feed tray 24, which is a place without a mechanism for taking out sheets P, can be reduced.

Second Embodiment

Next, a description is given of a second embodiment, which is a modification of the first embodiment for the operation performed when a jam occurs during double-sided printing.

In the second embodiment, when a jam of a sheet P occurs during double-sided printing operation, the mechanical controller 104 of the controller 16 stops sheet conveyance altogether at the time of the occurrence of the jam. If a sheet P not causing the jam is stopped while nipped only by either or both of the second pair of intermediate conveyance rollers 57 and the pair of reverse rollers 59 when the sheet conveyance is stopped upon the occurrence of the jam, the main controller 101 gives a user a notification instructing to remove a sheet P other than this sheet P from the conveyance route, instead of instructing to remove this sheet P.

In the following, a sheet P stopped while nipped only by either or both of the second pair of intermediate conveyance rollers 57 and the pair of reverse rollers 59 when sheet conveyance is stopped is referred to as a "specific-location stop sheet" (a specific sheet) where necessary.

When there is a specific-location stop sheet not causing the jam, after a sheet P other than the specific-location stop sheet is removed the mechanical controller 104 moves the specific-location stop sheet to a position to be nipped by the first pair of horizontal conveyance rollers 61, which is a pair of conveyance rollers other than the pair of conveyance rollers associated with the jam release door 11. Then, the main controller 101 gives the user a notification instructing to remove the specific-location stop sheet by operating the jam release door 11.

Next, an operation performed when a jam occurs during double-sided printing is described with reference to a flowchart in FIG. 12.

Figure 12:
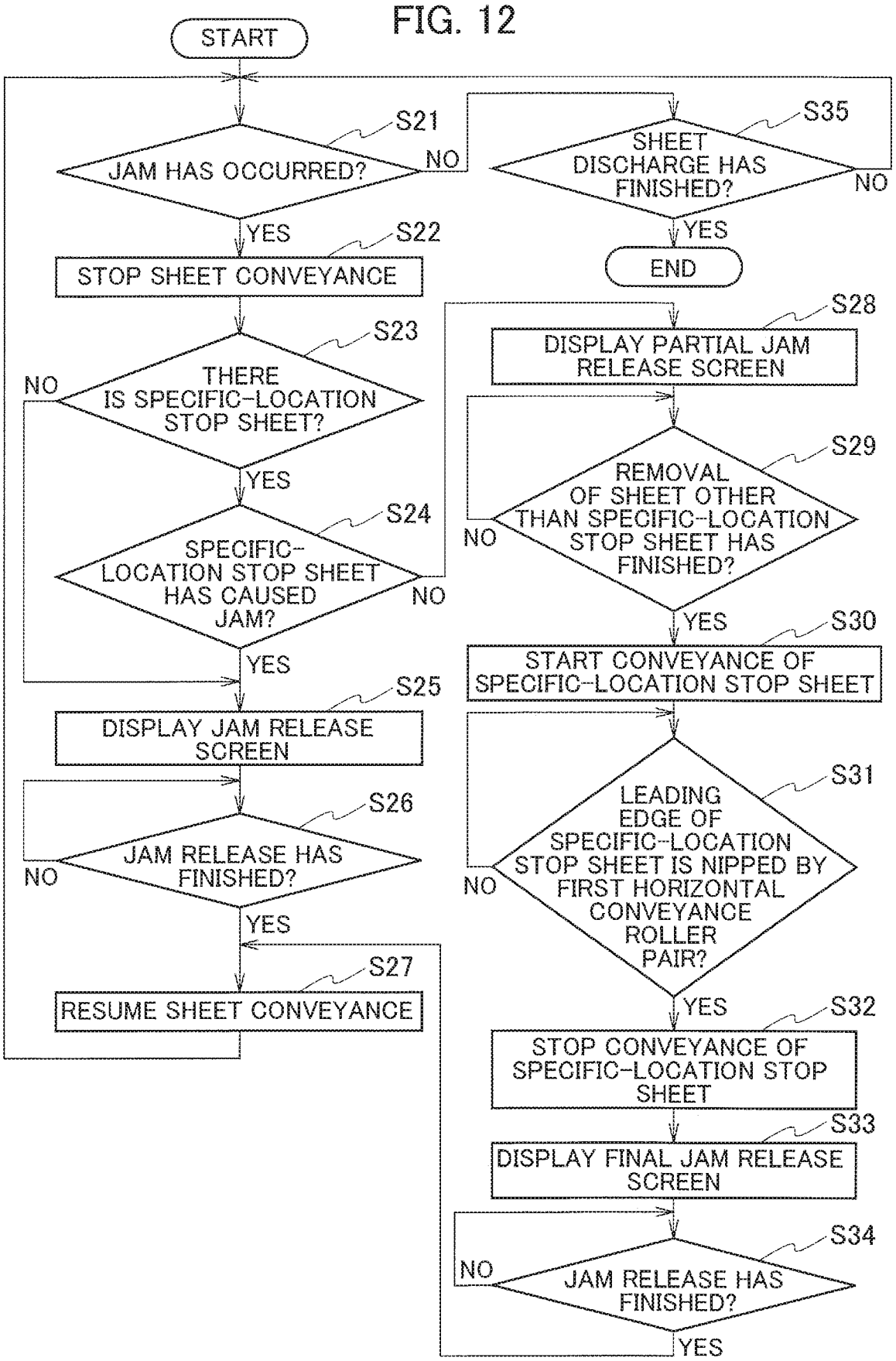
FIG. 12 is a flowchart illustrating how a printing apparatus according to a second embodiment operates when a jam occurs during double-sided printing.

The processing in the flowchart in FIG. 12 is started when sheet feed and conveyance for double-sided printing is started.

In Step S21 in FIG. 12, the mechanical controller 104 determines whether a jam of a sheet P has occurred.

When determining that a jam has occurred (Step S21: YES), in Step S22 the mechanical controller 104 stops sheet conveyance.

Next, in Step S23 the mechanical controller 104 determines whether there is a specific-location stop sheet, which is a sheet P stopped while nipped only by either or both of the second pair of intermediate conveyance rollers 57 and the pair of reverse rollers 59. The mechanical controller 104 determines whether there is a specific-location stop sheet, based on whether the sheet sensors 67 to 69 have detected a sheet at the time of the stop of the sheet conveyance (at the time of the occurrence of the jam) and on the differences in time between the sheet detection by the sheet sensors 67 and 68 and the stop of the sheet conveyance.

When determining that there is a specific-location stop sheet (Step S23: YES), in Step S24 the mechanical controller 104 determines whether the specific-location stop sheet is causing the jam.

When the mechanical controller 104 determines that the specific-location stop sheet is causing the jam (Step S24: YES), the operation proceeds to Step S25. When the mechanical controller 104 determines in Step S23 that there is no specific-location stop sheet (Step S23: NO), the operation skips Step S24 and proceeds to Step S25. Processing in Steps S25 to S27 is the same as the processing in Steps S8 to S10 described above using FIG. 7.

When the mechanical controller 104 determines in Step S24 that the specific-location stop sheet is not causing the jam (Step S24: NO), in Step S28 the main controller 101 displays a partial jam release screen (not shown) on the display 91.

The partial jam release screen gives the user a notification instructing to remove a sheet P other than the specific-location stop sheet from the conveyance route, instead of instructing to remove the specific-location stop sheet by operating the jam release door 11. The partial jam release screen instructs the user to remove the sheet P by opening a necessary one or ones of the front cover 17 and the jam release doors 8 to 10 and 12 to 14. Seeing the partial jam release screen, the user performs the work of removing the sheet P other than the specific-location stop sheet.

Next, in Step S29 the mechanical controller 104 determines whether the work of removing the sheet P other than the specific-location stop sheet has finished. The mechanical controller 104 determines that the sheet removal work has finished when the one or ones of the front cover 17 and the jam release doors 8 to 10 and 12 to 14 opened for the sheet removal are closed. When determining that the work of removing the sheet P other than the specific-location stop sheet has not finished yet (Step S29: NO), the mechanical controller 104 repeats Step S29.

When determining that the work of removing the sheet P other than the specific-location stop sheet has finished (Step S29: YES), in Step S30 the mechanical controller 104 starts conveyance of the specific-location stop sheet.

Next, in Step S31 the mechanical controller 104 determines whether the leading edge of the specific-location stop sheet is nipped by the first pair of horizontal conveyance rollers 61. When determining that the leading edge of the specific-location stop sheet is yet to be nipped by the first pair of horizontal conveyance rollers 61 (Step S31: NO), the mechanical controller 104 repeats Step S31.

When determining that the leading edge of the specific-location stop sheet is nipped by the first pair of horizontal conveyance rollers 61 (Step S31: YES), in Step S32 the mechanical controller 104 stops the conveyance of the specific-location stop sheet. By this operation, the specific-location stop sheet is stopped with its leading edge nipped by the first pair of horizontal conveyance rollers 61, as the sheet P illustrated in FIG. 9 is.

Next, in Step S33 the main controller 101 displays a final jam release screen (not shown) on the display 91. The final jam release screen gives the user a notification instructing to remove the specific-location stop sheet by operating the jam release door 11. Seeing the final jam release screen, the user opens the jam release door 11 and performs the work of removing the specific-location stop sheet.

Next, in Step S34 the mechanical controller 104 determines whether the sheet removal work has finished. The mechanical controller 104 determines that the sheet removal work has finished when the jam release door 11 is closed. When determining that the sheet removal work has not finished yet (Step S34: NO), the mechanical controller 104 repeats Step S34.

When determining that the sheet removal work has finished (Step S34: YES), the mechanical controller 104 proceeds to Step S27.

When determining in Step S21 that a jam has not occurred (Step S21: NO), in Step S35 the mechanical controller 104 determines whether discharge of sheets equaling the number of sheets to be printed has finished. When determining that discharge of sheets equaling the number of sheets to be printed has not finished yet (Step S35: NO), the mechanical controller 104 proceeds back to Step S21. When the mechanical controller 104 determines that discharge of sheets equaling the number of sheets to be printed has finished (Step S35: YES), the series of operation ends.

In the second embodiment as described above, when there is a specific-location stop sheet not causing a jam after sheet conveyance is stopped upon the occurrence of the jam, the main controller 101 gives a user a notification instructing to remove a sheet P other than the specific-location stop sheet from the conveyance routes, instead of instructing to remove the specific-location stop sheet. After the sheet P other than the specific-location stop sheet is removed, the mechanical controller 104 moves the specific-location stop sheet until the specific-location stop sheet is nipped by the first pair of horizontal conveyance rollers 61.

This makes it less likely that the jam release door 11 is opened with a sheet P being nipped only by either or both of the second pair of intermediate conveyance rollers 57 and the pair of reverse rollers 59. As a result, this can reduce sheets P falling to the space under the second internal sheet feed tray 24, which is a place without a mechanism for taking out the sheets P.

Third Embodiment

Next, a third embodiment, which is a partly-modified version of the first embodiment, is described.

In the third embodiment, when the mechanical controller 104 of the controller 16 brings sheet conveyance to an emergency stop during double-sided printing operation due to a failure other than a sheet conveyance failure (e.g., paper jam), and then if there is a specific-location stop sheet, which is a sheet P stopped while nipped only by either or both of the second pair of intermediate conveyance rollers 57 and the pair of reverse rollers 59, the main controller 101 gives a user a notification instructing to remove a sheet P other than the specific-location stop sheet from the conveyance route, instead of instructing to remove the specific-location stop sheet. After the sheet P other than the specific-location stop sheet is removed, the mechanical controller 104 moves the specific-location stop sheet until it is nipped by the first pair of horizontal conveyance rollers 61. Thereafter, the main controller 101 gives the user a notification instructing to remove the specific-location stop sheet by operating the jam release door 11.

Next, emergency stop handling processing according to the third embodiment is described with reference to a flowchart in FIG. 13.

The emergency stop handling processing is performed to prompt a user to remove a sheet P remaining on the conveyance routes when sheet conveyance is brought to an emergency stop due to a failure other than a sheet conveyance failure, such as a failure in the print control system, during double-sided printing operation. The processing in the flowchart in FIG. 13 is started when sheet conveyance is brought to an emergency stop due to a failure other than a sheet conveyance failure during double-sided printing operation.

Figure 13:
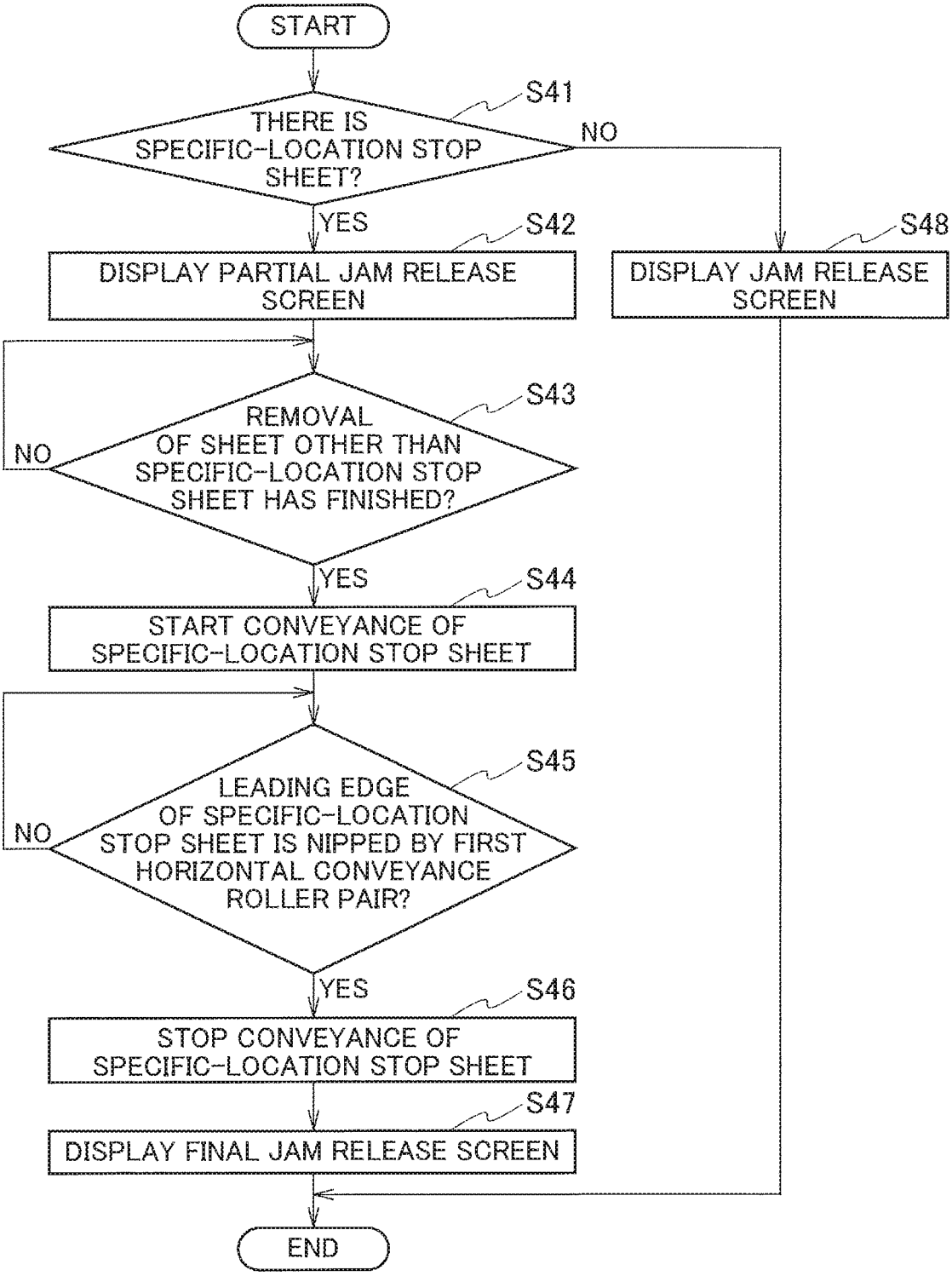
FIG. 13 is a flowchart of emergency stop handling processing according to a third embodiment.

In Step S41 in FIG. 13, the mechanical controller 104 determines whether there is a specific-location stop sheet, which is a sheet P stopped while nipped only by either or both of the second pair of intermediate conveyance rollers 57 and the pair of reverse rollers 59.

When the mechanical controller 104 determines that there is a specific-location stop sheet (Step S41: YES), the processing proceeds to Step S42. Processing in Steps S42 to S47 is the same as the processing in Steps S28 to S33 described above using FIG. 12.

When the final jam release screen is displayed on the display 91 in Step S47, the emergency stop handling processing ends. Seeing the final jam release screen, the user opens the jam release door 11 and performs the work of removing the specific-location stop sheet.

When the mechanical controller 104 determines in Step S41 that there is no specific-location stop sheet (Step S41: NO), in Step S48 the main controller 101 displays the jam release screen on the display 91, as it is in Step S8 of FIG. 7 described earlier. With this, the emergency stop handling processing ends. Seeing the jam release screen, the user performs the work of removing a sheet P remaining on the conveyance route.

In the third embodiment as described above, when there is a specific-location stop sheet after sheet conveyance is brought to an emergency stop due to a failure other than a sheet conveyance failure, the main controller 101 gives a user a notification instructing to remove a sheet P other than the specific-location stop sheet from the conveyance routes, instead of instructing to remove the specific-location stop sheet. After the sheet P other than the specific-location stop sheet is removed, the mechanical controller 104 moves the specific-location stop sheet until it is nipped by the first pair of horizontal conveyance rollers 61. Thereafter, the main controller 101 gives the user a notification instructing to remove the specific-location stop sheet by operating the jam release door 11.

This can make it less likely that the jam release door 11 is opened with the sheet P being nipped only by either or both of the second pair of intermediate conveyance rollers 57 and the pair of reverse rollers 59. This consequently can reduce sheets P falling to the space under the second internal sheet feed tray 24, which is a place without a mechanism for taking out the sheet P.

Fourth Embodiment

Next, a description is given of a fourth embodiment, which is a modification of the first embodiment for the operation performed when a jam occurs during double-sided printing.

In the fourth embodiment, when a jam occurs during double-sided printing operation, the mechanical controller 104 of the controller 16, depending on the position of a sheet P causing the jam at the time of the occurrence of the jam, stops sheet conveyance altogether upon the occurrence of the jam, even if there is, among sheets P other than the sheet P causing the jam, a sheet P to be stopped while nipped only by either or both of the second pair of intermediate conveyance rollers 57 and the pair of reverse rollers 59 (or in other words, to be a specific-location stop sheet).

When there is a specific-location stop sheet not causing a jam after sheet conveyance is stopped upon the occurrence of the jam, the main controller 101 gives a user a notification instructing to remove a sheet P other than the specific-location stop sheet, instead of instructing to remove the specific-location stop sheet. After the sheet P other than the specific-location stop sheet is removed, the mechanical controller 104 moves the specific-location stop sheet until it is nipped by the first pair of horizontal conveyance rollers 61. Thereafter, the main controller 101 gives the user a notification instructing to remove the specific-location stop sheet by operating the jam release door 11.

Next, an operation performed when a jam occurs during double-sided printing according to the fourth embodiment is described with reference to flowcharts in FIGS. 14 and 15.

Figure 14:
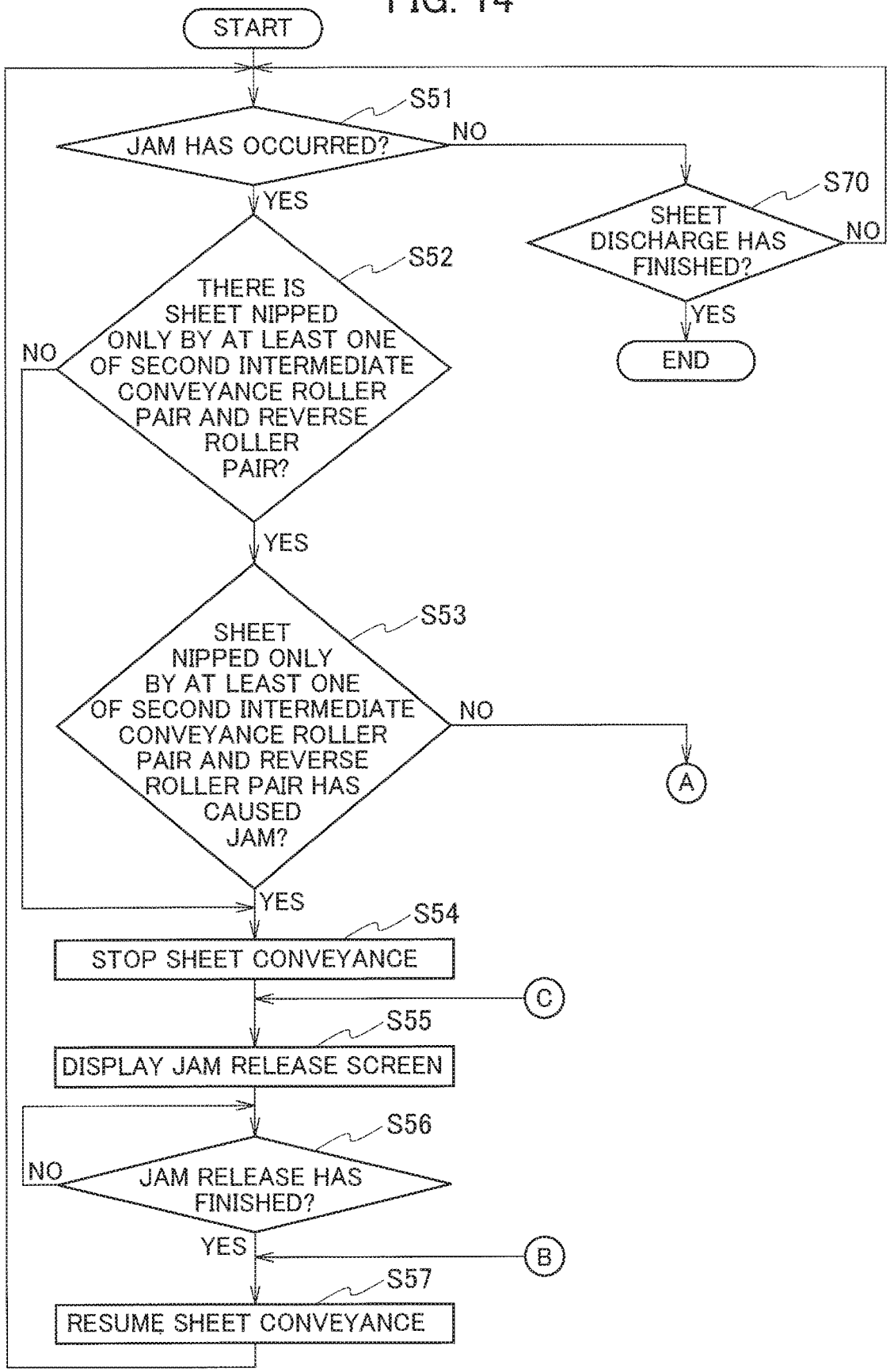
FIG. 14 is a flowchart illustrating how a printing apparatus according to a fourth embodiment operates when a jam occurs during double-sided printing.
Figure 15:
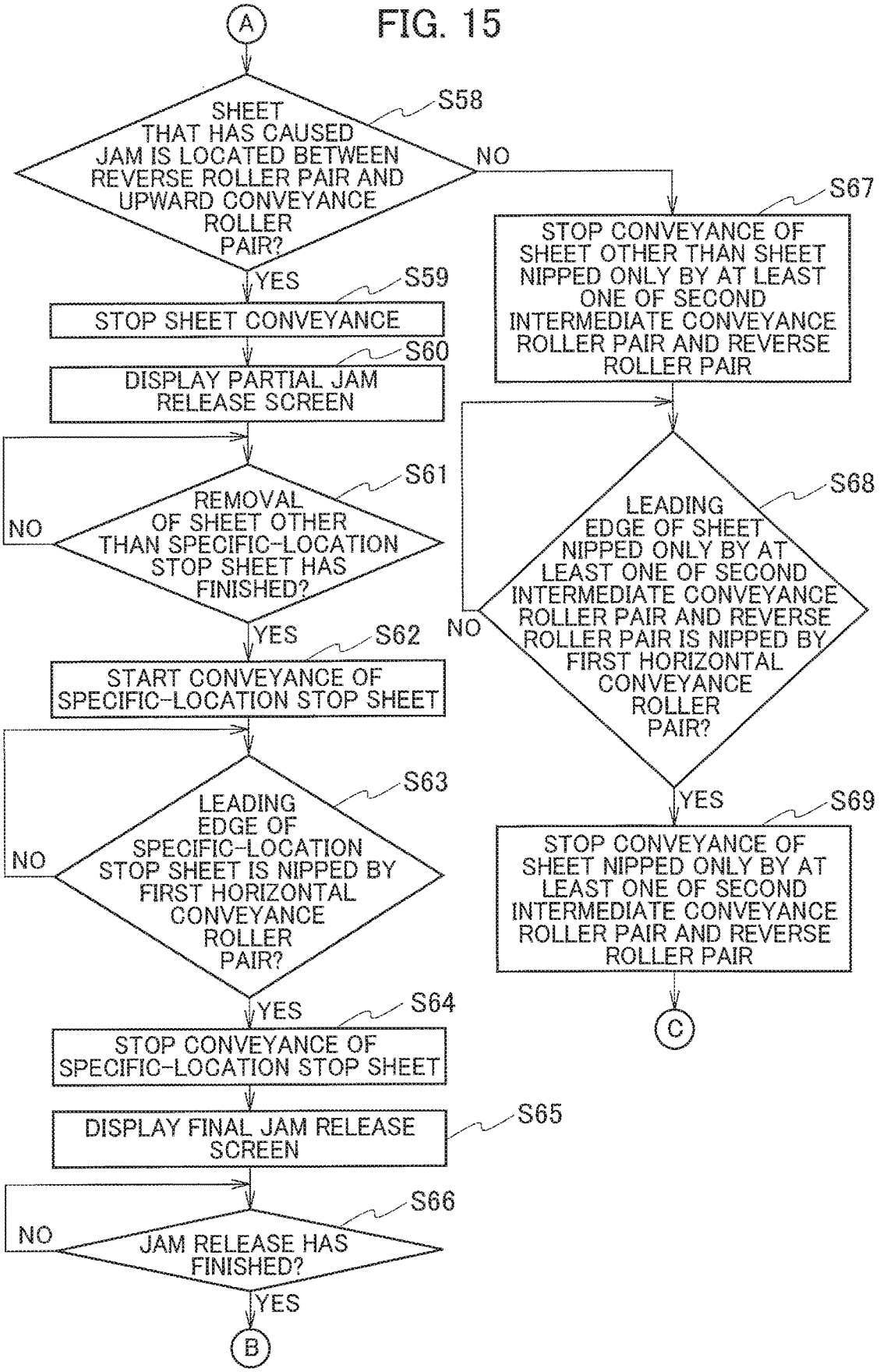
FIG. 15 is a flowchart illustrating how the printing apparatus according to the fourth embodiment operates when a jam occurs during double-sided printing.

Processing in the flowcharts in FIGS. 14 and 15 is started when sheet feed and conveyance for double-sided printing is started.

Processing in Steps S51 to S57 is the same as the processing in Steps S1 to S4 and S8 to S10 in FIG. 7 described earlier.

When determining in Step S53 that the sheet P nipped only by either or both of the second pair of intermediate conveyance rollers 57 and the pair of reverse rollers 59 at the time of the occurrence of the jam is not a sheet P causing the jam (Step S53: NO), in Step S58 in FIG. 15 the mechanical controller 104 determines whether the sheet P causing the jam is located between the pair of reverse rollers 59 and the pair of upward conveyance rollers 65. The mechanical controller 104 determines that the sheet P causing the jam is located between the pair of reverse rollers 59 and the pair of upward conveyance rollers 65 if the jam has been detected based on a result that the timing of sheet detection by the sheet sensor 70 is behind its theoretical value by a threshold or more.

When determining that the sheet P causing the jam is located between the pair of reverse rollers 59 and the pair of upward conveyance rollers 65 (Step S58: YES), in Step S59 the mechanical controller 104 stops sheet conveyance altogether.

If the sheet P causing the jam is located between the pair of reverse rollers 59 and the pair of upward conveyance rollers 65, the sheet P is possibly nipped by either or both of the first and second pairs of horizontal conveyance rollers 61 and 62. As mentioned earlier, the first and second pairs of horizontal conveyance rollers 61 and 62 are driven by the same horizontal conveyance motor 64.

For these reasons, if the sheet P nipped only by either or both of the second pair of intermediate conveyance rollers 57 and the pair of reverse rollers 59 continues to be conveyed until its leading edge is nipped by the first pair of horizontal conveyance rollers 61 with the sheet P causing the jam being nipped by either or both of the first and second pairs of horizontal conveyance rollers 61 and 62, the sheet P causing the jam continues to be conveyed as well. This may, for example, cause the sheet P causing the jam to be bellow-shaped, aggravating the damage by the jam.

To avoid this, the mechanical controller 104 stops sheet conveyance altogether when determining that the sheet P causing the jam is located between the pair of reverse rollers 59 and the pair of upward conveyance rollers 65 (Step S59).

Processing in Steps S60 to S66 is the same as the processing in Steps S28 to S34 in FIG. 12 described earlier. When determining in Step S66 that the jam release work has finished (Step S66: YES), the mechanical controller 104 proceeds to Step S57 in FIG. 14.

When determining in Step S58 that the sheet P causing the jam is not located between the pair of reverse rollers 59 and the pair of upward conveyance rollers 65 (Step S58: NO), the mechanical controller 104 proceeds to Step S67. Processing in Steps S67 to S69 is the same as the processing in Steps S5 to S7 in FIG. 7 described earlier.

When the sheet P nipped only by either or both of the second pair of intermediate conveyance rollers 57 and the pair of reverse rollers 59 at the time of the occurrence of the jam is stopped being conveyed in Step S69, the processing proceeds to Step S55 in FIG. 14.

When determining in Step S51 in FIG. 14 that a jam has not occurred (Step S51: NO), in Step S70 the mechanical controller 104 determines whether discharge of sheets equaling the number of sheets to be printed has finished. When determining that discharge of sheets equaling the number of sheets to be printed has not finished yet (Step S70: NO), the mechanical controller 104 proceeds back to Step S51. When the mechanical controller 104 determines that discharge of sheets equaling the number of sheets to be printed has finished (Step S70: YES), the series of operation ends.

In the fourth embodiment as described above, when a jam occurs during double-sided printing operation, the mechanical controller 104 of the controller 16 stops sheet conveyance altogether upon the occurrence of the jam, depending on the position of the sheet P causing the jam at the time of the occurrence of the jam. More specifically, if the sheet P causing the jam is located between the pair of reverse rollers 59 and the pair of upward conveyance rollers 65, the mechanical controller 104 stops sheet conveyance altogether upon the occurrence of the jam, even if any sheet P other than the sheet P causing the jam is to stop while nipped only by either or both of the second pair of intermediate conveyance rollers 57 and the pair of reverse rollers 59.

If there is, when the sheet conveyance is stopped, a specific-location stop sheet, which is a sheet P stopped while nipped only by either or both of the second pair of intermediate conveyance rollers 57 and the pair of reverse rollers 59, the main controller 101 gives a user a notification instructing to remove a sheet P other than the specific-location stop sheet, instead of instructing to remove the specific-location stop sheet. In the above case, the sheet P causing the jam is located between the pair of reverse rollers 59 and the pair of upward conveyance rollers 65, and the specific-location stop sheet is a sheet P other than the sheet P causing the jam.

After the sheet P other than the specific-location stop sheet is removed, the mechanical controller 104 moves the specific-location stop sheet until it is nipped by the first pair of horizontal conveyance rollers 61. Thereafter, the main controller 101 gives the user a notification instructing to remove the specific-location stop sheet by operating the jam release door 11.

The above operation thus prevents the sheet P causing the jam from being conveyed when the sheet P nipped only by either or both of the second pair of intermediate conveyance rollers 57 and the pair of reverse rollers 59 at the time of the occurrence of the jam is conveyed until it is nipped by the first pair of horizontal conveyance rollers 61. This suppresses aggravation of damage by the jam which would be caused if the sheet P causing the jam were conveyed.

Other Embodiments

In the first to fourth embodiments, the sheet P nipped only by either or both of the second pair of intermediate conveyance rollers 57 and the pair of reverse rollers 59 at the time of the occurrence of a jam is moved to be nipped by the first pair of horizontal conveyance rollers 61 before the jam release door 11 is opened, the first pair of horizontal conveyance rollers 61 being a pair of conveyance rollers which is not a pair of conveyance rollers associated with the jam release door 11 and which is a pair constant-nip rollers whose rollers are in constant contact.

However, the first pair of horizontal conveyance rollers 61 does not have to be a pair of constant-nip rollers, but may be configured so that the rollers 61*a* and 61*b* can be brought into and out of contact with each other by opening and closing of a jam release door other than the jam release door 11. Also with such a configuration, the sheet P does not fall when only the jam release door 11 is opened, and thus, sheets P falling to the space under the second internal sheet feed tray 24 can be reduced.

The present invention is applicable also when there is more than one jam release door like the jam release door 11 of the first to fourth embodiments which causes a sheet nipped only by a pair of conveyance rollers associated with the jam release door to fall to a place without a mechanism for taking out the sheet when the jam release door releases the nip by the pair of conveyance rollers by separating its rollers from each other.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a conveyor including a first pair of conveyance rollers and a second pair of conveyance rollers each configured to nip and convey a sheet;

a first jam releaser configured to separate rollers of the first pair of conveyance rollers from each other, the first jam releaser causing a sheet nipped only by the first pair of conveyance rollers to fall when releasing a nip of the sheet by separating the rollers of the first pair of conveyance rollers from each other;

rollers of the second pair of conveyance rollers not being separable from each other;

a plurality of sheet sensors; and a controller configured to control the conveyor such that upon a determination of an occurrence of a failure upon detection of a sheet by at least one of the plurality of sheet sensors, said failure being a sheet conveyance failure or a failure other than a sheet conveyance failure, the controller controls the conveyor to convey a sheet that is nipped only by the first pair of conveyance rollers and not having caused the failure, so that the sheet becomes nipped by the second pair of conveyance rollers prior to separation of the rollers of the first pair of conveyance rollers from each other by the first jam releaser, wherein the first jam releaser is configured such that when the first jam releaser causes a sheet nipped only by the first pair of conveyance rollers to fall by releasing the nip of the sheet by separating the rollers of the first pair of conveyance rollers from each other, the sheet falls in a place without a mechanism for taking out the sheet, the place being a space under a sheet feed tray that overlaps the sheet feed tray in the vertical direction, the sheet feed tray being arranged inside a chassis of the printing apparatus and including a part of a conveyance route of the sheet inside the chassis.

2. The printing apparatus according to claim 1, wherein the failure is a sheet jam, and upon the determination of an occurrence of the sheet jam, the controller is further configured to control the conveyor to convey a second sheet nipped only by the first pair of conveyance rollers other than a first sheet having caused the sheet jam so that the second sheet becomes nipped by the second pair of conveyance rollers and sheet conveyance is then stopped.

3. The printing apparatus according to claim 1, wherein the failure is a sheet jam, and the controller upon a position of a first sheet causing the sheet jam at a time of occurrence of the sheet jam satisfying a condition, stops the sheet conveyance by the conveyor altogether at the time of the occurrence of the sheet jam, upon a second sheet other than the first sheet being stopped while nipped only by the first pair of conveyance rollers when the sheet conveyance is stopped altogether, provides a user with a notification instructing to remove a sheet other than the second sheet from the conveyor, and upon determining that the sheet other than the second sheet has been removed, controls the conveyor to move the second sheet until the second sheet is nipped by the second pair of conveyance rollers.

4. The printing apparatus according to claim 3, wherein the condition includes a condition where the position of the first sheet at the time of the occurrence of the sheet jam is between the first pair of conveyance rollers and the second pair of conveyance rollers.

5. The printing apparatus according to claim 1, wherein the failure is a sheet jam, and the controller stops the sheet conveyance by the conveyor altogether at a time of occurrence of the sheet jam, upon a second sheet other than a first sheet causing the sheet jam being stopped while nipped only by the first pair of conveyance rollers when the sheet conveyance is stopped altogether, provides a user with a notification instructing to remove a sheet other than the second sheet from the conveyor, and upon determining that the sheet other than the second sheet has been removed, controls the conveyor to move the second sheet until the second sheet is nipped by the second pair of conveyance rollers.

6. The printing apparatus according to claim 1, wherein the controller upon a particular sheet being stopped while nipped only by the first pair of conveyance rollers when the sheet conveyance by the conveyor is brought to an emergency stop due to a failure other than the sheet conveyance by the conveyor, provides a user with a notification instructing to remove a sheet other than the particular sheet from the conveyor, and upon determining that the sheet other than the particular sheet has been removed, controls the conveyor to move the particular sheet until the particular sheet is nipped by the second pair of conveyance rollers.

7. The printing apparatus according to claim 1, wherein the first jam releaser is a door through which a user accesses a conveyance route for the sheet, and opening of the door separates the rollers of the first pair of conveyance rollers from each other.

8. The printing apparatus according to claim 1, wherein the second pair of conveyance rollers are horizontal conveyance rollers spaced from each other in a vertical direction to hold the sheet to extend horizontally.

9. The printing apparatus according to claim 1, wherein the first jam releaser is a first door, wherein the apparatus further comprises a second door configured to enable a user to access a conveyance route of the sheet, wherein the second pair of conveyance rollers is adjacent to a downstream side of the first pair of conveyance rollers, and wherein the second door is arranged downstream of the second pair of conveyance rollers.

* * * * *